US007178909B2

(12) United States Patent
Yoshiyama et al.

(10) Patent No.: US 7,178,909 B2
(45) Date of Patent: Feb. 20, 2007

(54) INK CARTRIDGE FOR PRINTER OR THE LIKE AND INK CARTRIDGE POSITIONING AND LOCKING MECHANISM

(75) Inventors: Masatoshi Yoshiyama, Nagoya (JP); Atsushi Murakami, Nagoya (JP); Yoshio Nakagawa, Kasugai (JP); Toyonori Sasaki, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/053,847

(22) Filed: Feb. 10, 2005

(65) Prior Publication Data

US 2005/0168547 A1 Aug. 4, 2005

Related U.S. Application Data

(60) Division of application No. 10/689,996, filed on Oct. 22, 2003, now Pat. No. 6,953,242, which is a continuation of application No. 10/108,567, filed on Mar. 29, 2002, now Pat. No. 6,666,542.

(30) Foreign Application Priority Data

| | | |
|---|---|---|
| Mar. 30, 2001 | (JP) | P2001-102424 |
| Jul. 13, 2001 | (JP) | P2001-214331 |
| Aug. 22, 2001 | (JP) | P2001-251634 |

(51) Int. Cl.
*B41J 2/175* (2006.01)
*B41J 2/14* (2006.01)

(52) U.S. Cl. ..... 347/86; 347/49

(58) Field of Classification Search ..... 347/2, 347/85, 86, 87, 108
See application file for complete search history.

(56) References Cited

U.S. PATENT DOCUMENTS 4,794,409 A * 12/1988 Cowger et al. ..... 347/87
5,448,274 A * 9/1995 Hirabayashi et al. ..... 347/86

(Continued)

FOREIGN PATENT DOCUMENTS

JP 5-162301 6/1993

(Continued)

*Primary Examiner*—Anh T. N. Vo
(74) *Attorney, Agent, or Firm*—Oliff & Berridge, PLC

(57) ABSTRACT

To accurately position and fix an ink cartridge on an ink cartridge mounting unit, a first engaging depression is formed in the bottom wall of the ink cartridge and a corresponding protrusion is formed in the mounting unit. Also, an ink supply port is formed in the bottom wall. When the ink cartridge is mounted on the mounting unit, the ink supply port is engaged first with an ink supply channel formed in the mounting unit and fluidly connected to the head unit. Then, the first engaging depression is brought into engagement with the corresponding protrusion in the mounting unit. A second engaging depression is further formed in the top. The engaging pawl of a locking arm engages the second engaging depression when the locking arm locks the ink cartridge to the head unit. Further, a pair of ribs is provided on the rear side wall of the ink cartridge. The ribs oppose each other with a prescribed interval. A corresponding protrusion protrudes from the head unit and fits into the space between the interval of the ribs when the ink cartridge is mounted in the head unit.

15 Claims, 18 Drawing Sheets

U.S. PATENT DOCUMENTS

| | | | | |
|---|---|---|---|---|
| 5,552,816 | A | 9/1996 | Oda et al. | |
| 5,619,239 | A | 4/1997 | Kotaki et al. | |
| 5,805,187 | A | 9/1998 | Sasaki | |
| 6,070,974 | A * | 6/2000 | Kotaki et al. | 347/86 |
| 6,250,750 | B1 * | 6/2001 | Miyazawa et al. | 347/87 |
| 6,270,207 | B1 * | 8/2001 | Sasaki | 347/86 |
| 6,511,167 | B1 * | 1/2003 | Kitabatake et al. | 347/86 |
| 6,722,762 | B2 * | 4/2004 | Miyazawa et al. | 347/86 |
| 6,899,417 | B1 * | 5/2005 | Shinada et al. | 347/86 |
| 2002/0140778 | A1 | 10/2002 | Yoshiyama et al. | |
| 2002/0140788 | A1 | 10/2002 | Usui et al. | |

FOREIGN PATENT DOCUMENTS

| | | |
|---|---|---|
| JP | 05-162301 | 6/1993 |
| JP | 05-330076 | 12/1993 |
| JP | 08-048044 | 2/1996 |
| JP | 10-181037 | 7/1998 |
| JP | A 11-192719 | 7/1999 |
| JP | 2000-71472 | 3/2000 |
| JP | 2000-218811 | 8/2000 |

* cited by examiner

FIG.3(a)
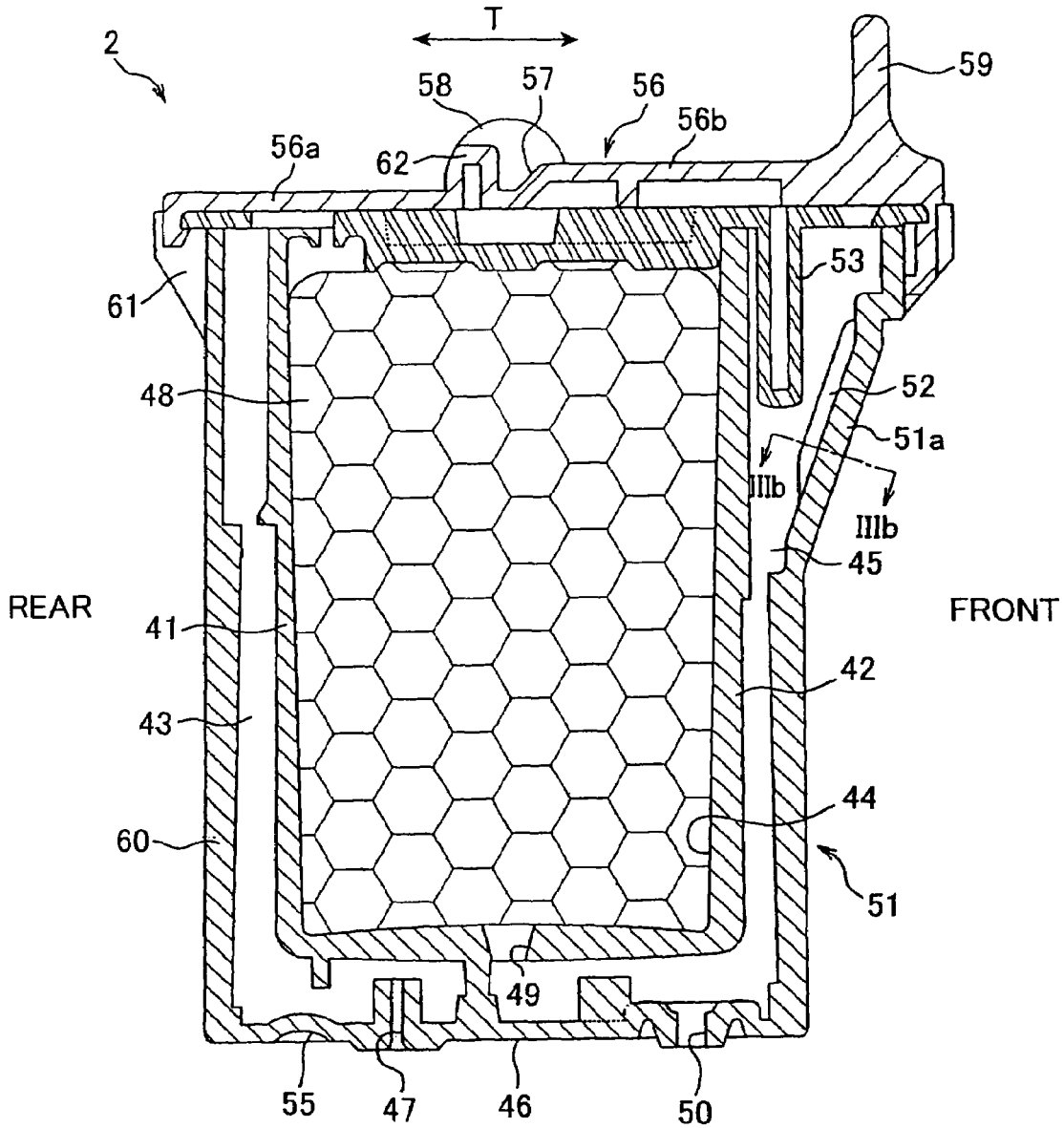
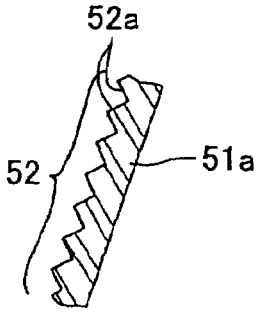
FIG.3(b)
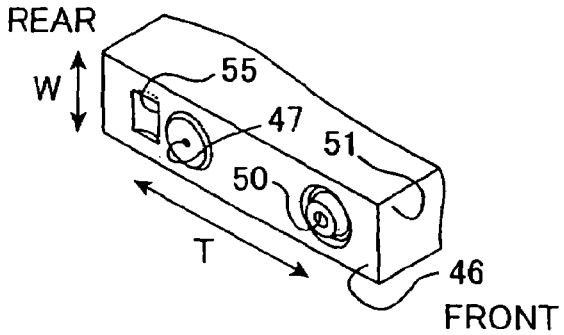
FIG.3(c)

INK CARTRIDGE FOR PRINTER OR THE LIKE AND INK CARTRIDGE POSITIONING AND LOCKING MECHANISM

This is a Divisional of application Ser. No. 10/689,996 filed Oct. 22, 2003 now U.S. Pat. No. 6,953,242, which in turn is a Continuation of application Ser. No. 10/108,567 filed Mar. 29, 2002 now U.S. Pat. No. 6,666,542. The entire disclosure of the prior applications are hereby incorporated by reference herein in their entirety.

BACKGROUND OF THE INVENTION

1. Field of the Invention

The present invention relates to an image-forming device for recording images on a recording medium by ejecting ink droplets thereonto, in which ink cartridges are detachably mounted on an ink cartridge mounting unit. More particularly, the invention relates to an ink cartridge positioning and locking mechanism for accurately positioning and fixing the ink cartridges on the ink cartridge mounting unit.

2. Description of the Related Art

Ink jet printers have been used extensively as they are simple in structure and are capable of high quality high speed printing. Typically, the ink jet printers include an ink jet head, an ink jet mounting unit, and an ink cartridge. The ink jet head ejects ink droplets onto a recoding medium to thereby form images thereon. The the ink jet head and is mounted on the carriage that moves in the widthwise direction of the print paper. The ink cartridge stores ink therein and is detachably mounted on the mounting unit.

The ink cartridge is formed with an ink supply port at its bottom for supplying ink to the ink jet head. In order to mount the ink cartridge on the mounting unit, the ink supply port is firstly engaged with the corresponding part in the mounting unit, and then a locking arm swingably provided at an upper portion of the head holder is moved downward toward the ink cartridge to press the ink cartridge downward. As a result, the ink cartridge is fixedly mounted on the mounting unit.

However, the ink cartridge mounted on the mounting unit tends to move as the carriage moves back and forth at a high speed. More specifically, the ink cartridge swings or vibrates about the ink supply port in the direction in which the carriage moves, with a result that ink in the ink cartridge is shifted to one side and thus using all the ink is impossible. Provision of another locking member may prevent the ink cartridge from swinging, however, this makes the entire structure complicated and mounting and detaching operation of the ink cartridge becomes complicated.

SUMMARY OF THE INVENTION

In view of the foregoing, it is an object of the invention to provide an ink cartridge positioning and locking mechanism that enables an ink cartridge or a set of ink cartridges to accurately position and fix on an ink cartridge mounting unit.

It is another object of the invention to provide an image-forming device that has a corresponding structure allowing the ink cartridge to be mounted.

To achieve the above and other objects, an ink cartridge of the invention includes a bottom wall that is substantially a rectangular shape, a first side wall (front side wall), a second side wall (rear side wall), a third side wall (right side wall), a fourth side wall (left side wall), and a top wall, thereby forming a substantial box shape and defining an inner space. A first engaging depression is formed in the bottom wall in a position nearer to the left side wall. When the ink cartridge is mounted on the cartridge mounting unit, the first engaging depression engages an engaging protrusion formed in the mounting unit. An ink supply port is formed in the bottom wall. The ink supply port is provided in a position nearer to the right side wall. The ink supply port is brought into engagement with an ink supply channel fluidly connected to the head unit.

A second engaging depression is formed in the top wall in a position corresponding to a center position between the first engagement depression and the ink supply port. The engaging pawl of a locking arm engages the second engaging depression when the locking arm locks the ink cartridge to the head unit. Further, a pair of ribs is provided on the left side wall to oppose each other with a prescribed interval. An engaging protrusion protrudes from the head unit and fits into the spaced between the interval of the ribs when the ink cartridge is mounted in the head unit.

BRIEF DESCRIPTION OF THE DRAWINGS

The particular features and advantages of the invention as well as other objects will become apparent from the following description taken in connection with the accompanying drawings, in which:

FIG. 3(*a*) is a side cross-sectional view of the ink cartridge in FIG. 2;

FIG. 3(*b*) is a cross-sectional view, taken along a line IIIb—IIIb in FIG. 3(*a*), showing the prism formed surface;

FIG. 3(*c*) is a perspective view showing the bottom of the ink cartridges in FIG. 2;

FIG. 10(*b*) is a front view showing a positional relationship of a changeover member relative to a frame;

FIG. 13(*b*) is a front view showing the changeover member used in the second embodiment;

FIG. 13(*c*) is a left side view showing the changeover member used in the second embodiment;

FIG. 13(*d*) is an enlarged cross-sectional view, taken along a line XIII—XIII in FIG. 13(*b*), showing a part of the changeover member;

FIG. 19(*b*) is a cross-sectional view taken along a line XIXb—XIXb in FIG. 19(*a*);

FIG. 20(*b*) is a cross-sectional view taken along a line XXb—XXb in FIG. 20(*a*).

DETAILED DESCRIPTION OF THE PREFERRED EMBODIMENTS

In the following description, the expressions "front", "rear", "left", "right", "above" and "below" and the like are used throughout the description to define the various parts when a color ink jet printer or other types of image-forming device is disposed in an orientation in which it is intended to be used.

A first embodiment of the present invention will be described with reference to FIGS. 1, 2 and 3(*a*)–3(*c*). The first embodiment pertains to a color ink jet printer 1 capable of printing in color.

Figure 1:
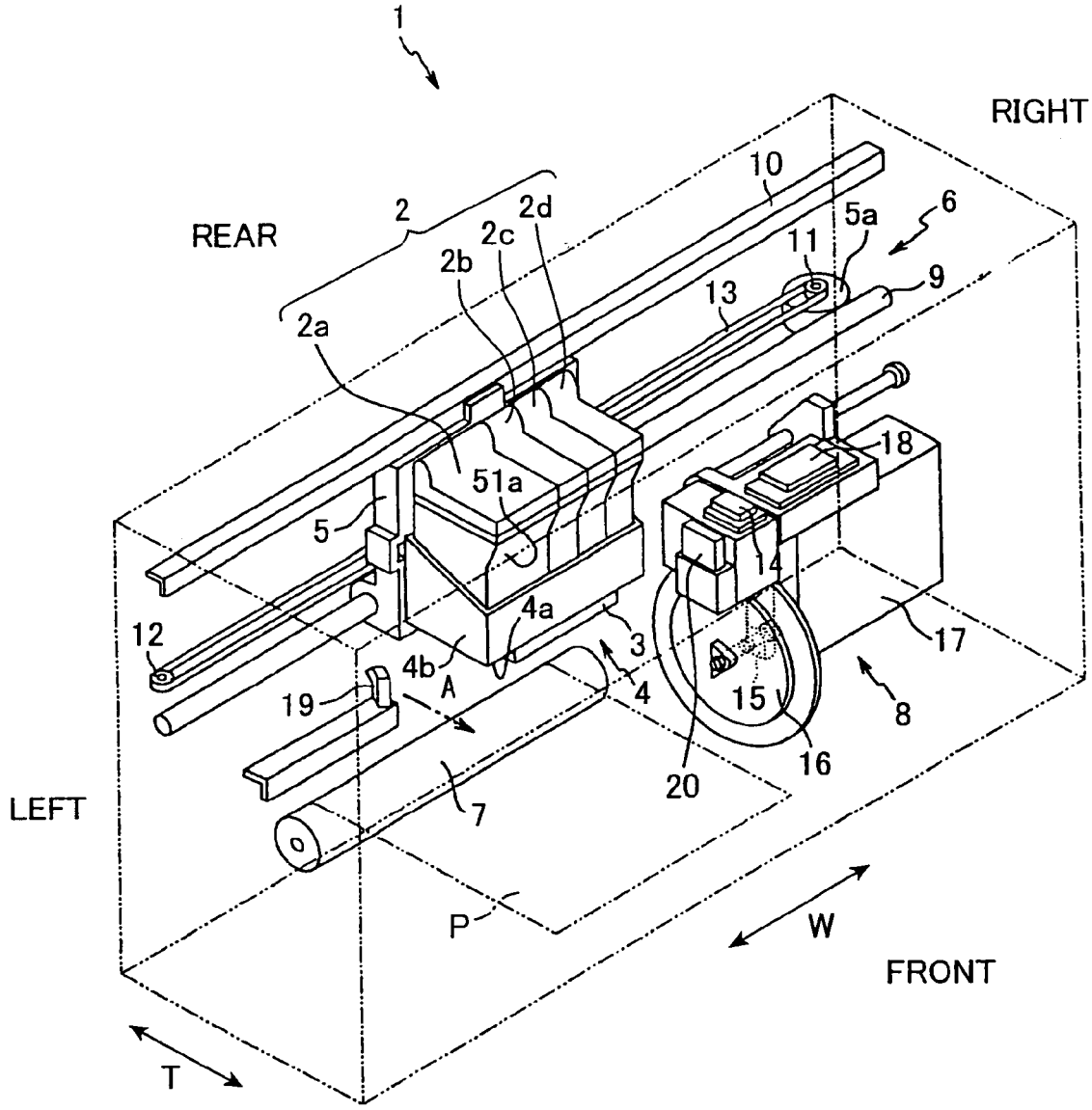
FIG. 1 is a perspective view showing the general configuration of a color ink jet printer according to a first embodiment of the invention.
Figure 2:
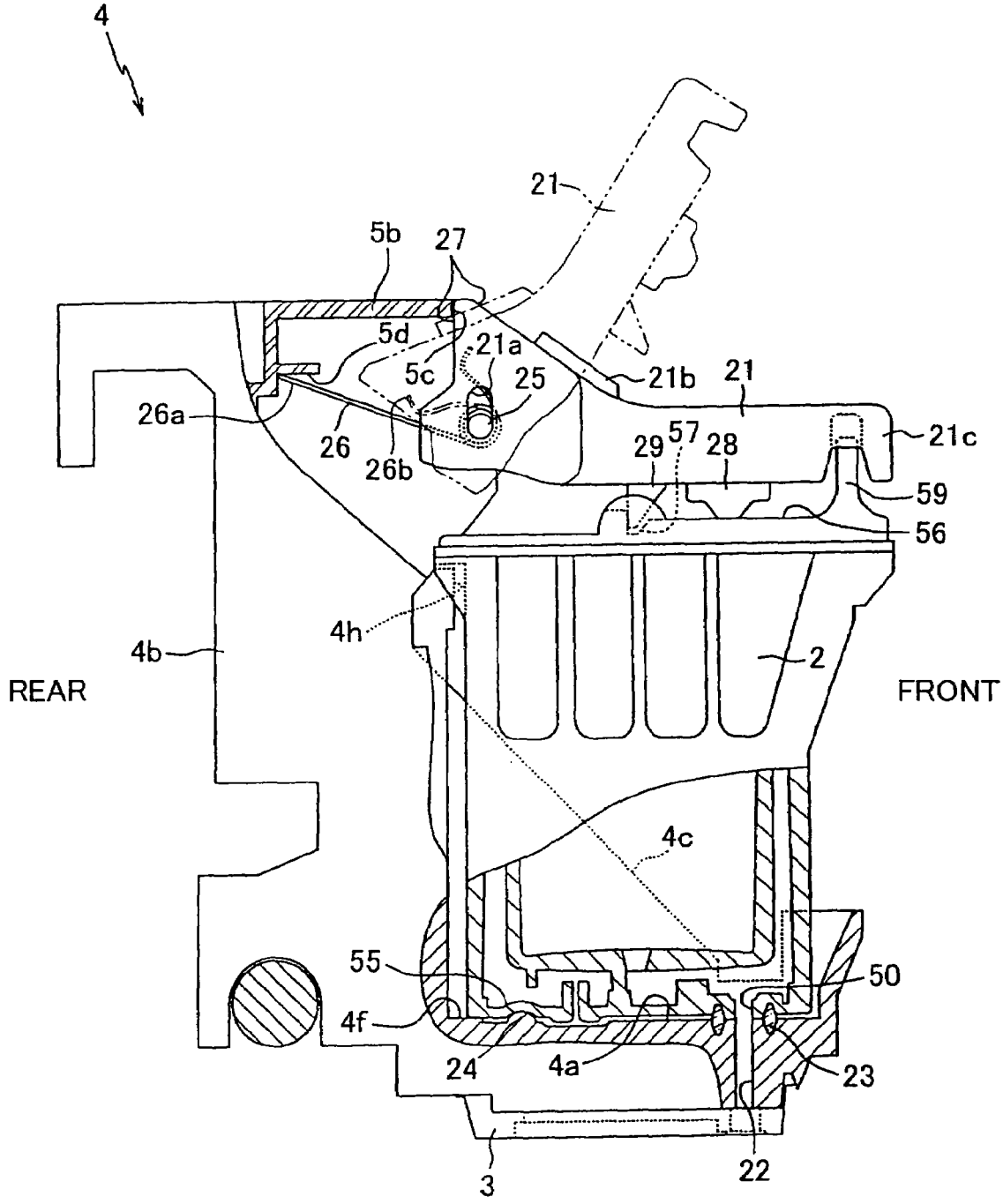
FIG. 2 is a side and partial cross-sectional view showing an ink cartridge mounted in the head unit of the ink jet printer in FIG. 1.

FIG. 1 is a perspective view showing the general configuration of the ink jet printer 1. As shown, the printer 1 is provided with four ink cartridges 2*a*, 2*b*, 2*c* and 2*d* storing ink of the colors black, cyan, magenta, and yellow. The ink jet printer 1 is further provided with a head unit 4, a carriage 5, a drive unit 6, and a purging unit 8. The head unit 4 is mounted on the carriage 5 and includes the print head 3. The drive unit 6 moves the carriage 5 along with the head unit 4 reciprocally in a straight line along a widthwise direction W. The platen roller 7 is disposed in opposition to the print head 3 and extends in the widthwise direction W. The purging unit 8 performs well known purging operations.

Figure 4:
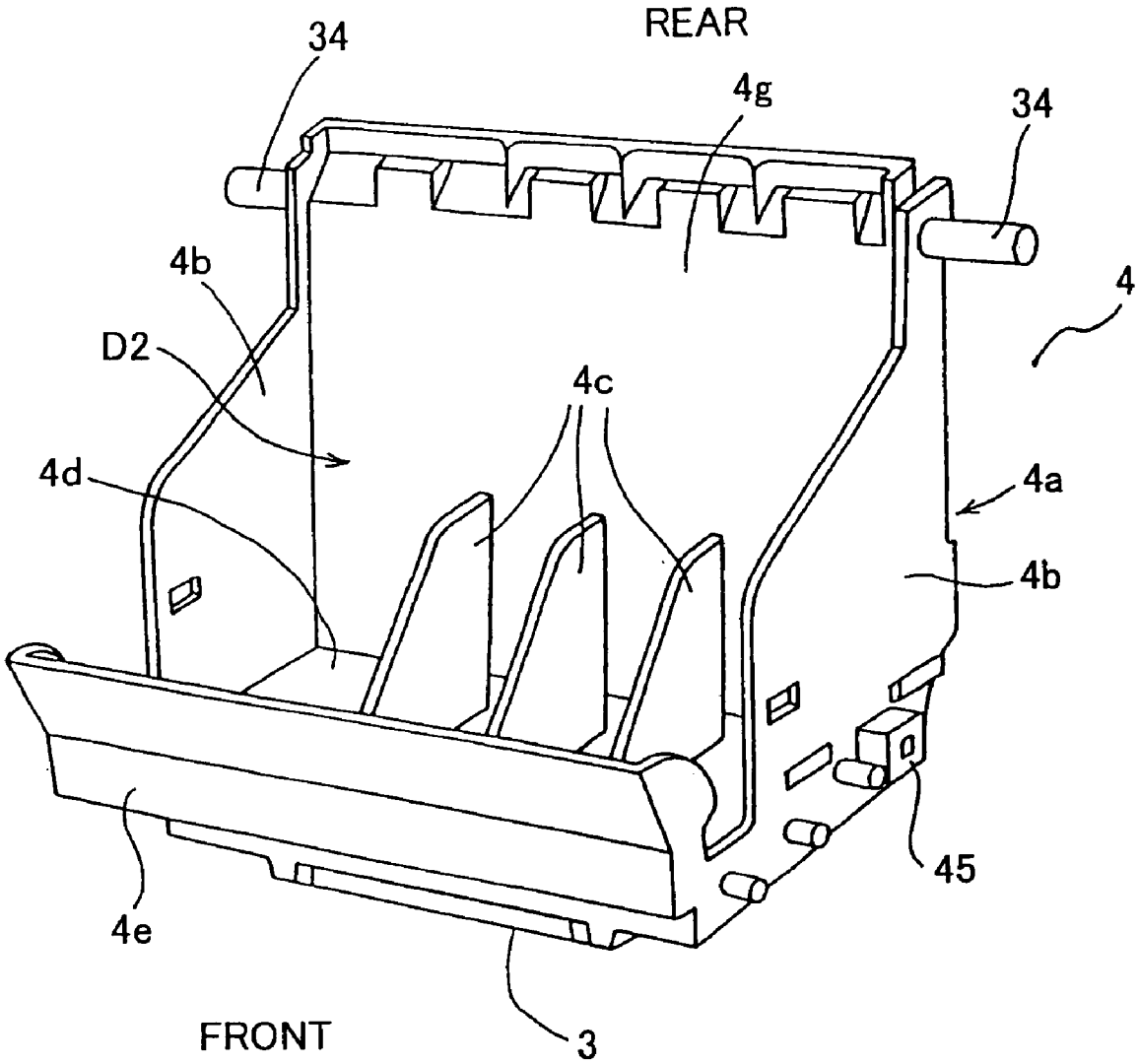
FIG. 4 is a perspective view showing the head unit of the ink jet printer in FIG. 1.

As shown in FIG. 4, the head unit 4 includes a print head 3 and a mounting unit 4*a*. The mounting unit 4*a* is formed with substantially flat bottom wall 4*d*, a pair of side walls 4*b* formed on both sides of the bottom wall 4*d*, and a front wall 4*e*. An inner space D2 defined by the bottom wall 4*d*, side walls 4*b*, and the front wall 4*d* is partitioned into four spaces by three partitioning walls 4*c*. In these four spaces are detachably mounted four ink cartridges 2*a*, 2*b*, 2*c*, 2*d* (for the sake of brevity, one of these ink cartridges will simply be referred to as "ink cartridge 2") filled with black ink, cyan ink, magenta ink, and yellow ink. The ink inside the ink cartridges 2 is supplied to the print head 3. As can be seen from FIG. 1, the ink cartridge 2*a* filled with black ink has a larger capacity than the other ink cartridges 2*b*, 2*c*, 2*d* filled with the other three colors of ink, taking into account that black ink is used more frequently than the others.

Figure 7:
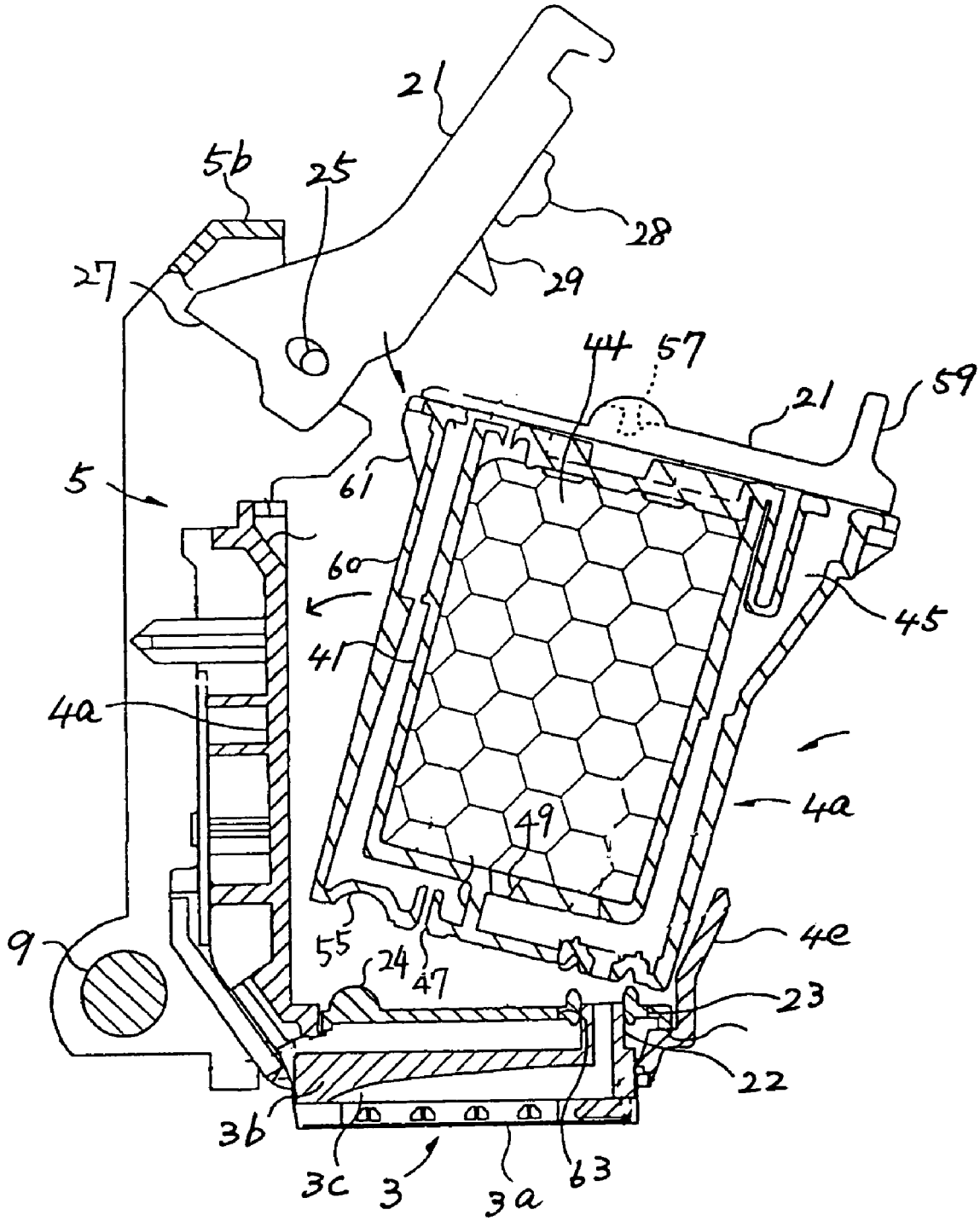
FIG. 7 is a cross-sectional view showing mounting of the ink cartridge onto the head unit.

As depicted in FIG. 7, the print head 3 includes an actuator 3*a* and a manifold 3*b* bonded to the upper side of the actuator 3*a*. The actuator 3*a* is formed with a plurality of ejection channels for ejecting ink droplets from the associated nozzles. The manifold 3*b* supplies ink to the respective ejection channels. The manifold 3*b* is formed with a pipe-shaped ink supply channel 22 and an ink supply chamber 3*c* for distributing the ink to the respective ejection channels of the actuator 3*a*. The actuator 3*a* is formed from a piezoelectric ceramics and deforms when a voltage is applied. Ink droplets are ejected from the corresponding nozzle when the inner volume of the ejection channel reduces. On the other hand, ink is supplemented from the ink cartridge 2 when the inner volume of the ejection channel increases.

Figure 6:
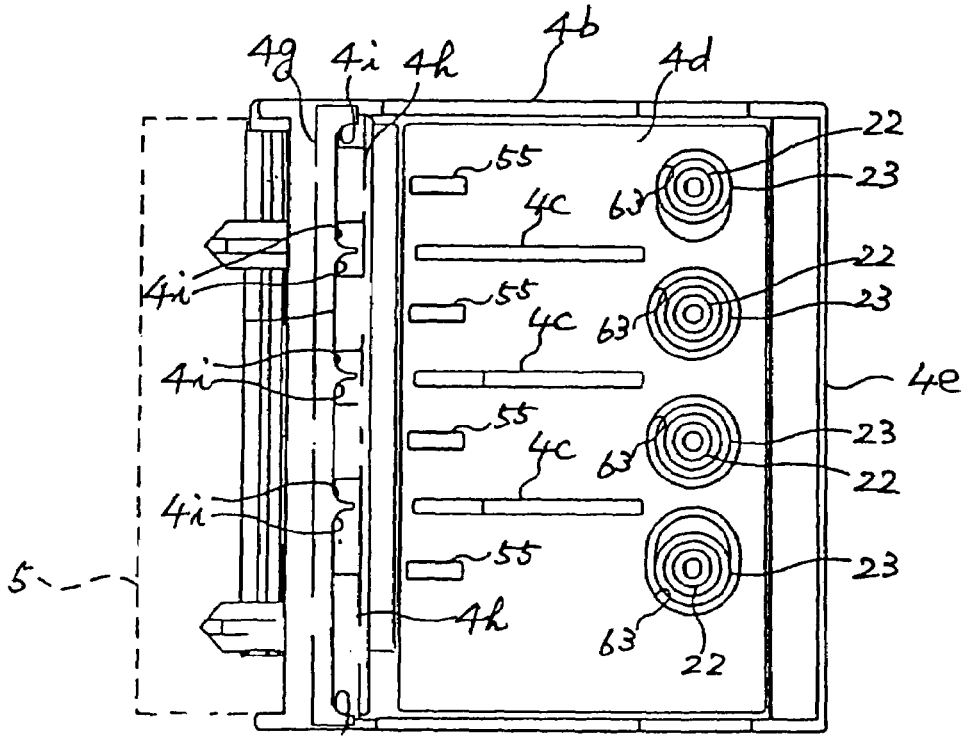
FIG. 6 is a plan view showing a mounting unit for mounting the ink cartridge and an ink jet head.

As shown in FIG. 6, the mounting unit 4*a* has a bottom wall 4*d* formed with an opening 63. An O-ring 23 is fitted into the opening 63 for a sealing purpose. A circular groove 64 formed in the outer periphery of the ink supply port 50 of the ink cartridge 2 is elastically engaged with the O-ring 23, thereby fluidly connecting the sub ink reservoir 45 of the ink cartridge 2 with the ink supply channel 22 via the O-ring.

Although not shown in the drawings, the print head 3 has a nozzle surface formed with a plurality of nozzles defining nozzle lines in a lengthwise direction T, and performs a prescribed printing operation by selectively ejecting ink droplets through the nozzles onto the recording sheet P. This printing operation is performed by alternately and repeatedly executing one-pass printing for printing one-pass-worth of image with the print head 3 and a line-feed operation for feeding the recording sheet P in the direction A by a distance equivalent to the one-pass-worth of image. A print region covered in the one-pass printing is within a region having a length of the nozzle lines in the conveying direction of the recording sheet P (that is, the lengthwise direction T) and a maximum printing width in the widthwise direction W of the recording sheet P. Accordingly, the recording sheet P is moved a distance in each line-feed operation equivalent to the length of the nozzle lines.

The drive unit 6 includes a carriage shaft 9 engaging the bottom end of the carriage 5 and extending parallel to the platen roller 7, a guide plate 10 engaging on the top end of the carriage 5 and extending parallel to the carriage shaft 9, two pulleys 11 and 12 disposed adjacent to both ends of the carriage shaft 9 between the carriage shaft 9 and the guide plate 10, an endless belt 13 looped around both the pulleys 11 and 12, and a carriage motor 5*a* disposed adjacent to the pulley 11.

The carriage motor 5*a* drives the pulley 11 to rotate forward or in reverse. At this time, the carriage 5 attached to the endless belt 13 moves reciprocally in the widthwise direction W along the carriage shaft 9 and the guide plate 10 according to the forward or reverse rotation of the pulley 11.

The purging unit 8 is provided on the rightside of the platen roller 7 and opposes the print head 3 when the head unit 4 is in a predetermined reset position. The purging unit 8 includes a purge cap 14, a pump 15, a cam 16, and an ink reservoir 17. The purging unit 8 performs the purging operation when the head unit 4 is in the reset position. That is, the purge cap 14 contacts the nozzle surface of the print head 3 so as to cover the nozzles in the print head 3. The cam 16 drives the pump 15 to draw out defective ink containing air bubbles and the like from the print head 3. The defective ink drawn out of the print head 3 is stored in the ink reservoir 17.

A wiping member 20 is disposed adjacent to the left side of the purging unit 8. The wiping member 20 is formed in a spatula shape and wipes the nozzle surface of the print head 3 as the carriage 5 moves across. A cap 18 is positioned adjacent to the purge cap 14 for covering the nozzles in the print head 3 in order to prevent the ink from drying when the print head 3 returns to the reset position after the printing process ends.

The ink sensor 19 is disposed near the left end of the drive unit 6 for detecting the existence of the ink cartridges 2 and the existence of ink therein. The ink sensor 19 includes an infrared light-emitting element, an infrared light-receiving element, and an A/D converter connected to the infrared light-receiving element.

Next, the configuration for fixing the ink cartridges 2 in the head unit 4 will be described with reference to FIGS. 2 through 8.

Referring first to FIG. 3(*a*) that shows a cross-sectional side view of the ink cartridge 2, the ink cartridge 2 has a bottom wall 46. The bottom wall 46 is substantially a rectangular shape having a first side, a second side, a third side and a fourth side. The second side opposes the first side. The third side connects the first side and the second side. The fourth side opposes the third side. Although not shown in FIG. 3(*a*), a first side wall protrudes upward from the bottom wall along the first side, and a second side wall along the second side. As depicted in FIG. 3(*a*), a third side wall 51 protrudes upward from the bottom wall along the third side, and a fourth side wall 60 along the fourth side.

The ink cartridge 2 has a top wall 56 opposing the bottom wall 46. The bottom wall 46, the first side wall, the second side wall, the third side wall 51, the fourth side wall 60, and the top wall 56 form a substantial box shape and define an inner space of the ink cartridge 2.

As shown in FIGS. 3(*a*) and 3(*c*), the bottom wall 46 is formed with a first engaging depression 55, an air hole 47, and an ink supply port 50 in order, beginning from the rear side. The first engaging depression 55 is formed approximately in the center of the ink cartridge 2 in the widthwise direction W. Also, the first engaging depression is formed in a position nearer to the fourth side than the third side. The ink supply port 50 is formed in a position nearer to the third side than the fourth side.

As shown in FIG. 3(*a*), the top wall 56 is formed with a first upper wall 56*a*, a first protrusion 62, a second engaging depression 57, a second upper wall 56*b*, and a handgrip 59 in order, beginning from the rear side. The first upper wall 56*a* is formed at a height from the bottom wall 46 lower than that of the second upper wall 56*b*. The first protrusion 62 protrudes upward and forms the back wall of the second engaging depression 57. The handgrip 59 protrudes upward to provide a member that a user can easily grab when mounting and removing the ink cartridge 2 in and from the head unit 4.

To define the position of the ink supply port 50 in relation to the center of gravity of the ink cartridge 2, a reference position will be defined as follows for the sake of explanation. The reference point is a point on the bottom wall 46 and defined as a point where an imaginary vertical line passing via the center of gravity of the ink cartridge 2 intersects with the bottom wall 46. Using the reference point, the position of the ink supply port 50 is defined to be located in a position between the third side and the reference point.

FIG. 4 shows the head unit 4. The head unit 4 includes the mounting unit 4*a* and print head 3. The mounting unit 4*a* is formed with a bottom wall 4*d* that is substantially a rectangular shape having a first side (i.e., front longer side), a second side opposing the first side of the bottom wall (i.e., rear longer side), a third side connecting the first side and the second side of the bottom wall 4*d* (i.e., right shorter side), and a fourth side opposing the third side of the bottom wall 4*d* (i.e., left shorter side), a rear wall 4*g* upstanding from the bottom wall 4*d* along the second side of the bottom wall 4*b*, a first side wall 4*b* upstanding from the bottom wall 4*d* along the third side of the bottom wall 4*d*, and a second side wall 4*b* upstanding from the bottom wall 4*d* along the fourth side of the bottom wall 4*d*. The rear wall 4*g*, the pair of opposing side walls 4*b* of the mounting unit 4*a* define an ink cartridge receiving space D2. The mounting unit 4*a* has an open space above the bottom wall 4*d* of the mounting unit and above the first side of the bottom wall 4*d*, thereby allowing a user to easily mount or remove the ink cartridge 2.

Referring back to FIG. 2, the mounting unit 4*a* is formed with a protrusion 4*f*, an engaging protrusion 24, and an ink supply channel 22 in order, beginning from the rear side. More specifically, the protrusion 4*f* is formed on the rear side of the mounting unit 4*a* for restricting downward movement of the ink cartridge 2. The engaging protrusion 24 protrudes from the mounting unit 4*a* on the front side of the protrusion 4*f*. The engaging protrusion 24 engages the first engaging depression 55 formed in the bottom wall 46 of the ink cartridge 2 to fix the position of the ink cartridge 2. The ink supply channel 22 is formed in the front portion of the mounting unit 4*a* penetrating to the print head 3, enabling the ink supply channel 22 and the ink cartridge 2 to be in fluid communication with each other. Stated differently, the ink supply channel 22 is formed in a position nearer to the third side than the fourth side of the bottom wall 4*d*.

Accurate positioning is not possible with this connection between the ink supply channel 22 and the ink supply port 50 alone, as the ink cartridge 2 will rotate about the ink supply port 50 (O-ring 23) due to inertia generated by the moving carriage 5. However, this rotation is prevented by the engagement of the engaging protrusion 24 on the head unit 4 and the first engaging depression 55 on the bottom wall 46 as described above, thereby fixing the position of the ink cartridge 2. As a result, the ink cartridge 2 can be accurately fixed on the head unit 4.

An upper cover 5*b* and a locking arm 21 are disposed on top of the head unit 4. The upper cover 5*b* is a part of the carriage 5. The upper cover 5*b* has an engage part 5*d* and an end portion 5*c*. The locking arm 21 is for locking the ink cartridge 2 and rotatably supported by a swinging shaft 25 at one end. The swinging shaft 25 is fixedly supported by the carriage 5. An auxiliary spring member 26 is wound around the swinging shaft 25 for urging the locking arm 21 upward. One end 26*a* of the auxiliary spring member 26 is engaged with the engaging part 5*d* on the carriage 5, and another end 26*b* is fixed to the locking arm 21.

A stopper 27 having a triangular shape in side view is formed protruding from the rear end of the locking arm 21. A pressing unit 28 is formed to protrude from the bottom surface of the locking arm 21. The pressing unit 28 is capable of receding with respect to the locking arm 21, but is urging to protrude by a compression spring (not shown) disposed in the pressing unit 28 in an elastically compressed state.

When the locking arm 21 is closed as represented by a solid line, the stopper 27 engages the end portion 5*c* of the upper cover 5*b*, and the top wall 56 of the cartridge 2 contacts the pressing unit 28 causing the pressing unit 28 to recede upward, resisting the urging force of the compression spring. With this construction, the pressing unit 28 applies an urging force on the ink cartridge 2 according to the stopper 27 and the compression spring, pushing downward on and fixing the ink cartridge 2.

An engaging pawl 29 is fixed to the bottom surface of the locking arm 21 behind the pressing unit 28. The engaging pawl 29 engages in the second engaging depression 57 formed in the top wall 56 for fixing the position of the ink cartridge 2. Because the first protrusion 62 protrudes upward and forms the back wall of the second engaging depression 57 as described above, when the engaging pawl 29 engages in the second engaging depression 57, the first protrusion 62 prevents the ink cartridge 2 from shifting backward and from floating upward. Here, the second engaging depression 57 for engaging the engaging pawl 29 is disposed at a position corresponding to approximately the center in the thickness direction T and between the ink supply port 50 and the first engaging depression 55. Hence, the ink cartridge 2 is supported with good balance at three points, namely the second engaging depression 57, the ink supply port 50, and the first engaging depression 55. Accordingly, this configuration can prevent the ink cartridge 2 from rising up, leaning in one direction, or vibrating, thereby fixing the ink cartridge 2 on the head unit 4 in a stable state.

As shown in FIG. 3(*a*), a pair of opposing side plates 58 are provided one on each widthwise side of the second engaging depression 57. The space between the side plates 58 is approximately equivalent to the width of the engaging pawl 29. Hence, when the engaging pawl 29 is fitted into the second engaging depression 57, the pair of side plates 58 prevents the ink cartridge 2 from moving (deviating) in the widthwise direction W.

Since the head unit 4 is moved reciprocally during a printing operation while being abruptly accelerated and decelerated repeatedly, the ink cartridge 2 may deviate horizontally in the moving direction W. Such horizontal deviation may generate vibrations in the head unit 4 itself and have adverse effects on the printing quality. However, since the pair of side plates 58 prevents deviation (vibration) of the ink cartridge 2 in the moving direction W, the head unit 4 can move smoothly back and forth without vibrating, thereby maintaining a good printing quality.

Figure 5:
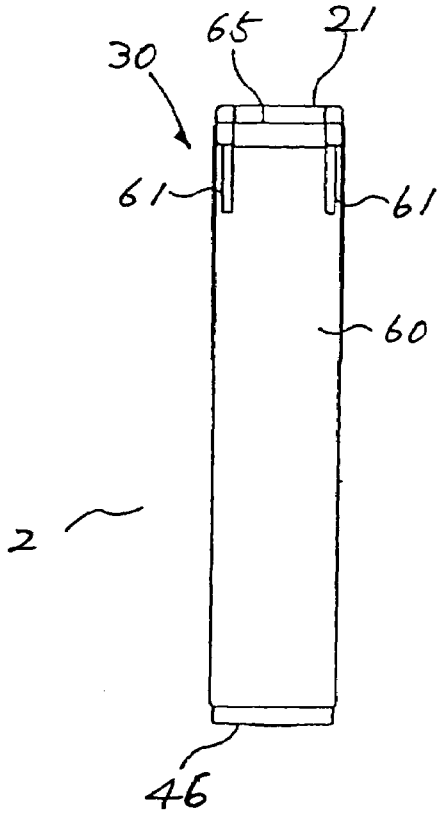
FIG. 5 is a rear view showing the ink cartridge in FIG. 1.
Figure 8:
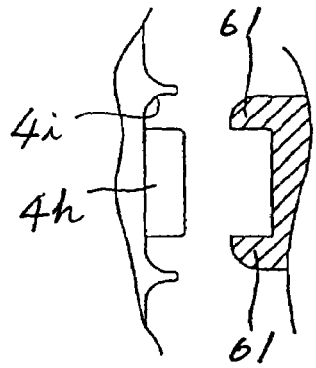
FIG. 8 is an enlarged horizontal cross-sectional view showing a rear portion of the ink cartridge engaging the mounting unit.

A pair of ribs 61 is also provided on the back of the ink cartridge 2. The ribs 61 oppose each other and are formed with the same prescribed interval as the side plates 58. As shown in FIGS. 5 and 6, an engaging protrusion 4*h* protrudes from the head unit 4 at a position corresponding to the pair of ribs 61. The engaging protrusion 4*h* is formed in a groove 4*i*. When the ink cartridge 2 is mounted in the head unit 4, the ribs 61 enter into the groove 4*i* and the engaging protrusion 4*h* is fitted into the interval between the ribs 61. Accordingly, this pair of ribs 61 prevents the ink cartridge 2 from deviating (vibrating) horizontally during the printing process also.

By not configuring the entire top wall 56 in a thin construction, it is possible to maintain rigidity in the top wall 56 to withstand pressure from the pressing unit 28.

A protrusion 21*b* is also formed on the locking arm 21. By pushing down on the protrusion 21*b*, the locking arm 21 slides downward along an elongated hole 21*a*, thereby disengaging the upper cover 5*b* and the stopper 27. The locking arm 21 springs upward by the urging force of the auxiliary spring member 26 and is maintained in the open position described by dotted lines. This configuration allows a wide space to be opened in the region that the ink cartridge 2 mount in the head unit 4, thereby improving the facilitating maintenance of the ink jet printer 1 for a user mounting or removing an ink cartridge 2. Here, the elongated hole 21*a* is formed of sufficient length to enable the stopper 27 to disengage from the upper cover 5*b*.

By gripping the handgrip 59, a single ink cartridge 2 can be removed from the head unit 4 without interference from neighboring ink cartridges 2. Likewise, when mounting an ink cartridge 2 in the head unit 4, the ink cartridge 2 can be easily mounted in its narrow space by gripping the ink cartridge 2 by the handgrip 59.

When mounting the ink cartridge 2, the back portion of the ink cartridge 2, that is the first upper wall 56*a* side, is inserted first into the prescribed position in the head unit 4. As described above, however, the first upper wall 56*a* is formed lower than the second upper wall 56*b*, thereby preventing interference between the first upper wall 56*a* and the pivoting portion of the locking arm 21 (the side near the stopper 27). Hence, the ink cartridges 2 can be easily mounted without catching on the head unit 4.

To return the locking arm 21 to its closed position, the operator simply presses down on a free end 21*c* of the locking arm 21. By pushing down on the free end 21*c*, the locking arm 21 swings down around the swinging shaft 25 until the pressing unit 28 contacts the top wall 56. By pushing further down on the free end 21*c*, the locking arm 21 rotates about the contact point between the pressing unit 28 and the top wall 56, forcing the stopper 27 positioned below the upper cover 5*b* to move right of the end portion 5*c*. At this point, the locking arm 21 is pushed upward along the elongated hole 21*a* by the urging force of the auxiliary spring member 26 and engages with the end portion 5*c*.

Next, the internal structure of the ink cartridge 2 will be described with reference to FIGS. 3(*a*) and 3(*b*). FIG. 3(*a*) shows the state of the ink cartridge 2 filled with no ink. FIG. 3(*b*) is a cross-sectional view taken along a line IIIb—IIIb of FIG. 3(*a*).

As shown in FIG. 3(*a*), the ink cartridge 2 is hollow with a substantial box shape. In addition to the bottom wall 46 and the top wall 56 mentioned above, the ink cartridge 2 has side walls 51 and 60. Partitions 41 and 42 are provided inside the ink cartridges 2 for partitioning the ink cartridge 2 into an air introduction chamber 43, a main ink reservoir 44, and a sub ink reservoir 45. The air introduction chamber 43 is in fluid communication with the air outside the ink cartridge 2 via the air hole 47. The top of the air introduction chamber 43 is in fluid communication with the main ink reservoir 44, enabling air to be introduced into the main ink reservoir 44.

The main ink reservoir 44 is an essentially airtight space for storing ink. Foam 48, which is made of porous material, is accommodated in the main ink reservoir 44 in a compressed state. The foam 48 is a porous member formed of a sponge, a fibrous material, or the like that is capable of retaining ink due to the capillary effect. Even if the ink cartridge 2 is inverted, for example, this configuration can prevent ink from flowing from the main ink reservoir 44 to the air introduction chamber 43 and leaking out of the ink cartridge 2 through the air hole 47. An ink channel 49 is formed in the partition 42 at the bottom of the main ink reservoir 44, enabling the main ink reservoir 44 to be in fluid communication with the sub ink reservoir 45.

The sub ink reservoir 45 is an essentially hermetically sealed space on the front of the ink cartridge 2 for storing ink. Ink stored in the main ink reservoir 44 and the sub ink reservoir 45 is supplied to the print head 3 via the ink supply port 50 as described above.

The side wall 51 that forms a front wall of the sub ink reservoir 45 is formed of a transparent light-permeable material. Examples of the light-permeable materials that can be used in this embodiment include acrylic resin, polypropylene, polycarbonate, polystyrene, polyethylene, polyamide, methacryl, methyl pentene polymer, and glass. The term transparent used above does not necessarily mean perfectly optically transparent, but can include the meaning translucent as well.

The side wall 51 includes a sloped portion 51*a*, which slopes downward toward the main ink reservoir 44 at approximately 20 degrees to the vertical. Prisms 52 are integrally formed along an inner surface of the sloped portion 51*a* spanning nearly the entire widthwise direction W of the sloped portion 51*a*. The prisms 52 are used to detect the existence of ink stored in the ink cartridge 2.

As shown in FIG. 3(*b*), the prisms 52 have a plurality of reflecting surfaces 52*a* by arranging the prisms 52 with alternating peaks and valleys. In the first embodiment, the reflecting surfaces 52*a* intersect with one another at an angle of about 90 degrees. The number of reflecting surfaces 52*a* is between eight and sixteen. The plurality of reflecting surfaces 52*a* are arranged along the widthwise direction W (perpendicular to the paper surface in FIG. 3(*a*)) and slope downward, as does the sloped portion 51*a*. Accordingly, the ink can flow down over the prisms 52, thereby preventing ink from remaining on the prisms 52, as residual ink can prevent a desired reflected light from being obtained from the prisms 52.

Referring to FIG. 3(*a*), a reflecting member 53 is formed on the top of the sub ink reservoir 45 in a manner to oppose the prisms 52 at a prescribed distance for changing the path of infrared light emitted from the ink sensor 19. The reflecting member 53 is formed in a pouch shape having an air pocket in the center, and extends in the vertical direction at an angle of 20 degrees to the prisms 52.

In the ink cartridge 2 having the construction described above, air is introduced from the air introduction chamber 43 into the main ink reservoir 44 when the print head 3 expends ink from the ink cartridge 2 in order to replace the expended ink. Accordingly, the level of ink in the main ink reservoir 45 drops. When ink is further expended until all the ink in the main ink reservoir 44 is used, ink remaining in the sub ink reservoir 45 is supplied to the print head 3. At this time, the sub ink reservoir 45 is decompressed, but air received from the air introduction chamber 43 via the main ink reservoir 44 is introduced into the sub ink reservoir 45 via the ink channel 49, thereby alleviating the decompression in the sub ink reservoir 45 and lowering the level of the ink.

That is, the ink cartridge 2 is configured such that first ink in the main ink reservoir 44 is expended and then ink in the sub ink reservoir 45 is expended after all ink in the main ink reservoir 44 has been used. Accordingly, by detecting the existence of ink in the sub ink reservoir 45 using the ink sensor 19, it is possible to determine the existence of ink for the entire ink cartridge 2.

A second embodiment of the invention will be described with reference to FIGS. 9 through 20(*b*). The second embodiment pertains to a facsimile/printer combined device.

Figure 9:
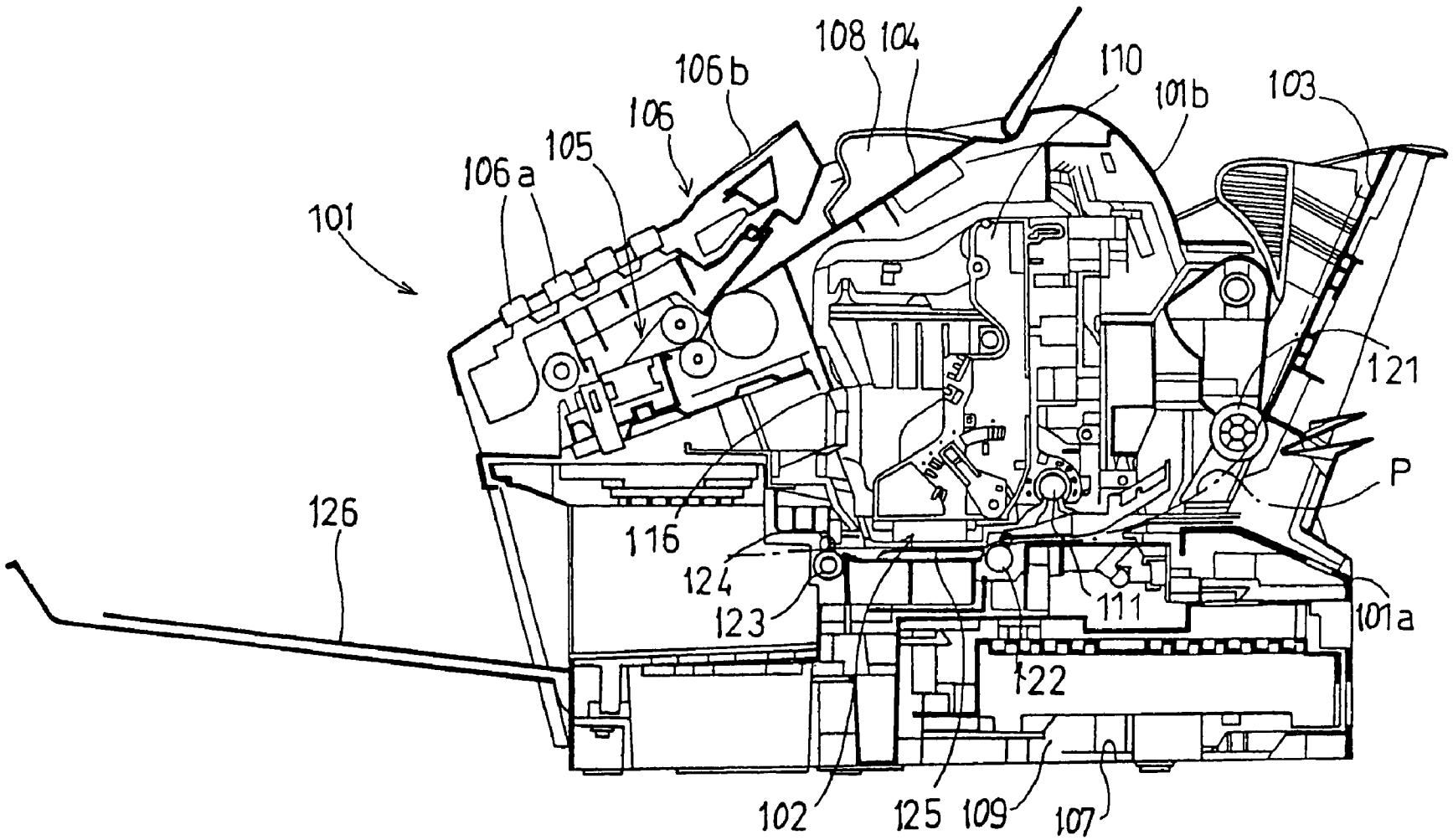
FIG. 9 is a cross-sectional view showing a facsimile/printer combined device according to a second embodiment of the invention.
Figures 10A, 10B:
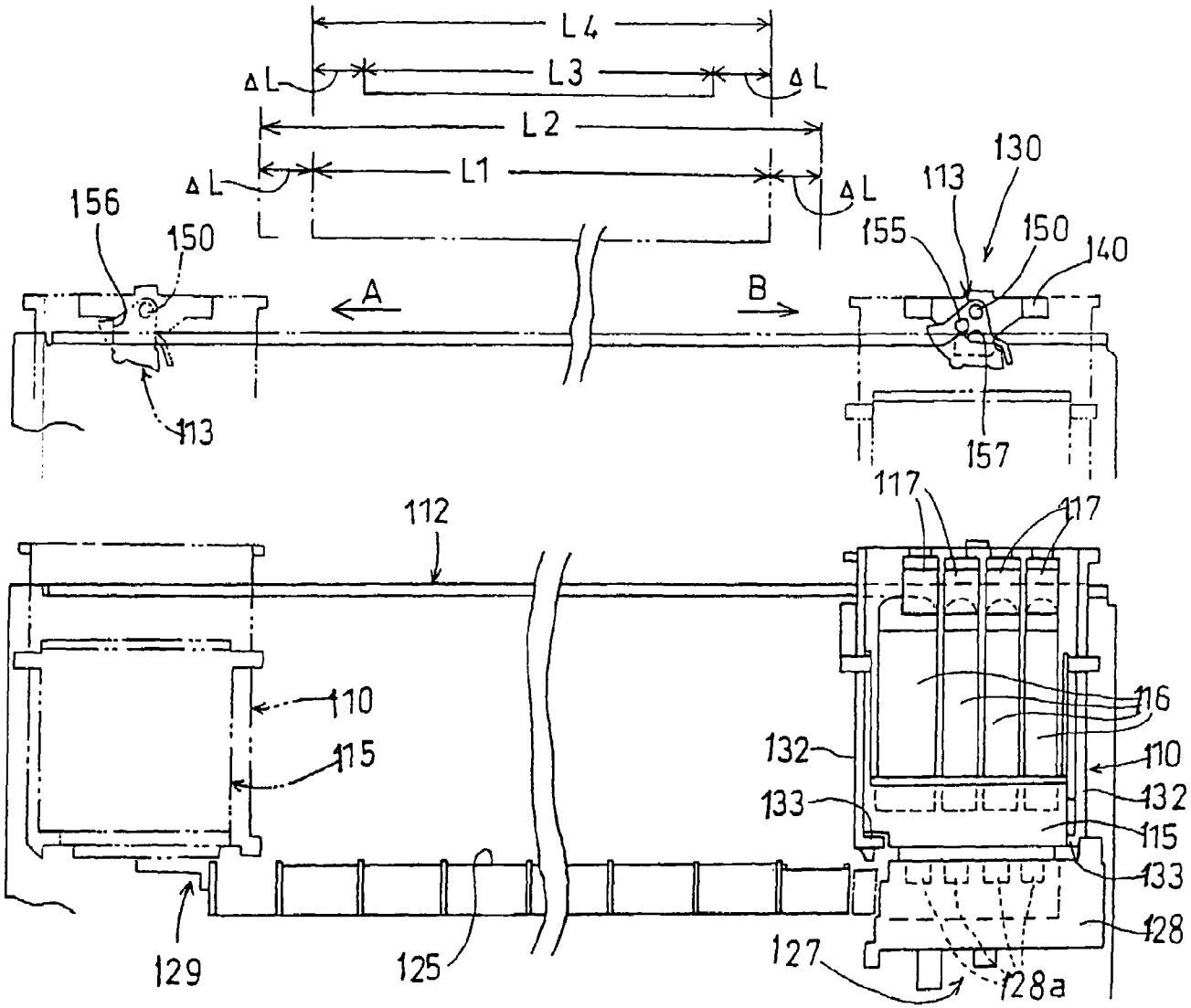
FIG. 10(*a*) is a plan view showing a carriage moving along the frame.

As shown in FIGS. 9, 10(*a*) and 10(*b*), the facsimile/printer combined device 100 includes an ink jet recording section 102, a main lower case 101*a*, and an upper case 101*b*. The main lower case 101*a* is made from a synthetic resin and is provided with a sheet feed tray 103 for supplying sheets of paper P into the recording section 102. The sheet feed tray 103 is held slanted at the upper rear portion of the main lower case 101*a*. The upper case 101*b* is also made from a synthetic resin and covers the upper portion of the main lower case 101*a*.

In front of the upper case 101*b*, an original document receiving section 104 is disposed, which is rotatable about the upper case 101*b*. Ink cartridge replacement is performed upon rotating the original document receiving section 104 to expose the ink jet recording section 102. The original document receiving section 104 has a pair of document guide members 108 which are synchronously movable toward and away from each other so that they are brought into contact with the side edges of the original documents. In front of the original document receiving section 104, an original document reading unit 105 is mounted. The upper portion of the original document reading unit 105 is covered with an operation panel 106. The operation panel 106 has an operation key part 106*a* including various kinds of function keys and ten numeral keys, and an liquid crystal display part 106*b* for displaying various instruction characters.

The lower surface of the main lower case 101*a* is covered with a bottom plate 107 made from metal. A control section 109 is disposed interiorly of the main lower case 101*a*. The control section 109 includes a control substrate, a power source substrate, and an NCU (network control unit) substrate for transmitting to and receiving from a remote telephone set or a remote facsimile device voice data or facsimile data. Although not shown in the drawing, a handset is disposed on a stand projecting horizontally outward from the side-plate of the main lower case 101*a*. A speaker is fixed to the rear portion of the right side plate of the main lower case 101*a*.

Figure 11:
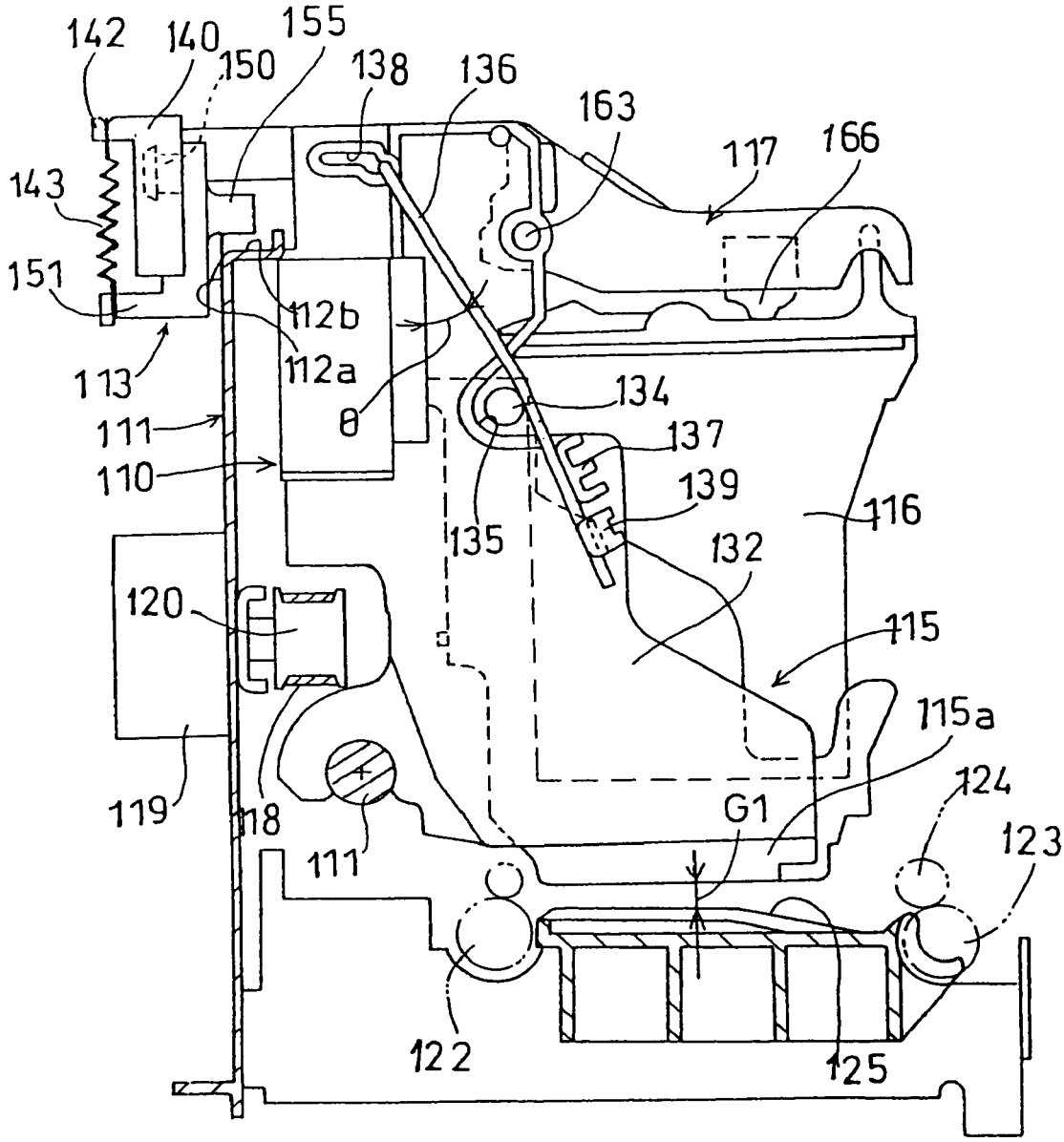
FIG. 11 is a cross-sectional view showing an ink cartridge mounted on a head unit of the second embodiment in which a gap between an ink jet head and a platen is set small.

As shown in FIG. 11, the carriage 110 is slidably movably supported on a carriage shaft 111. An endless belt 118 extends in parallel with the carriage shaft 111 and is stretched between a driven pulley and a drive pulley 120 operatively coupled to the output shaft of a reversibly rotatable drive motor 119, such as a stepping motor. The endless belt 118 is connected at one point to the carriage 110, so that the carriage 110 is reciprocally movable along the carriage shaft 111.

As best shown in FIG. 9, the sheets of paper P stacked in the sheet feed tray 103 are separated one by one by a sheet feed roller 121 and a separation member. The separated sheet of paper P is aligned to the registration roller 122 and then fed to a space between the recording section 102 and a platen 125. As the sheet of paper P is fed by a pair of transportation rollers 123, 125 disposed downstream of the recording section 102, ink droplets are ejected from the recording section 102 onto the sheet of paper P to record an image thereon. The sheet of paper P with the image recorded thereon is thereafter discharged onto a discharge tray 126.

As shown in FIG. 10(*b*), a maintenance section 127 is disposed at the right side of the platen 125. The position at which the maintenance section 127 is disposed is offset from the recording region and in the vicinity of the end position of the carriage moving path. The maintenance section 127 includes a wiping member and a purging unit 128. The wiping member wipes off ink clinging to the nozzle surface (see FIG. 12) of the head unit 115. The purging unit 128 has suction caps 128*a* which cover the nozzle surfaces 115*a* of the head unit 115 and suck ink in the head unit 115 with a negative pressure generated by a pump. The purging unit 128 is disposed in a home position (right side in FIG. 10(*b*)) at the end of carriage moving path. The purging unit 128 serves as a capping mechanism to entirely cover the nozzle surfaces 115*a* and prevent the nozzle surfaces 115*a* from being dried. Thus, the suction caps 128*a* function as protection caps. As best shown in FIG. 10(*b*), a flushing section 129 is disposed at the left side of the platen 125. The flushing section 129 forcibly ejects ink droplets to thereby eliminate ink clogging in the nozzles.

Next, a structure of the recording section 102 will be described.

The head unit 115 is the same in structure as that shown in FIG. 4, therefore the description thereof is not repeated here.

Figure 14:
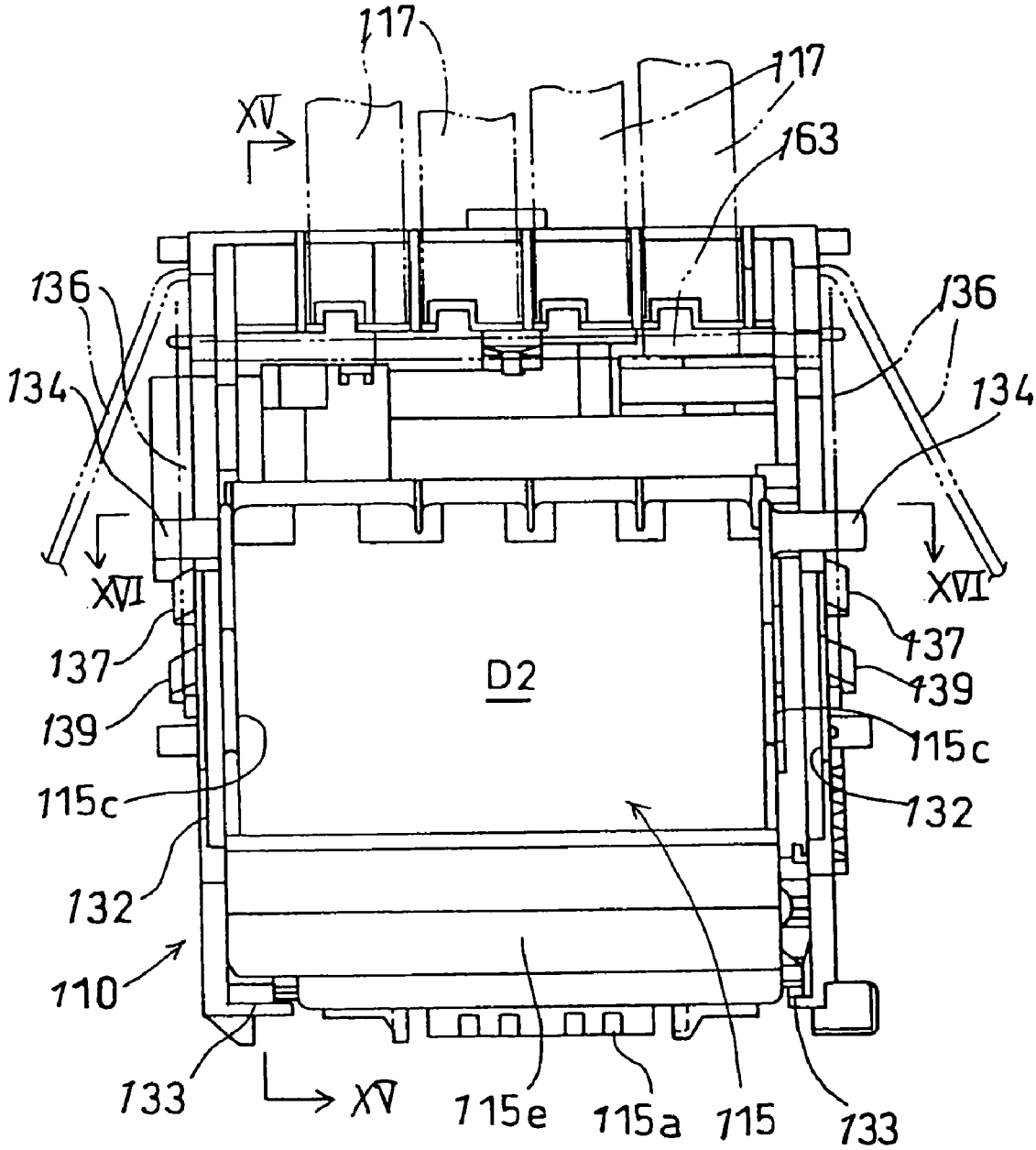
FIG. 14 is a front view showing the carriage on which the head unit is mounted.
Figure 15:
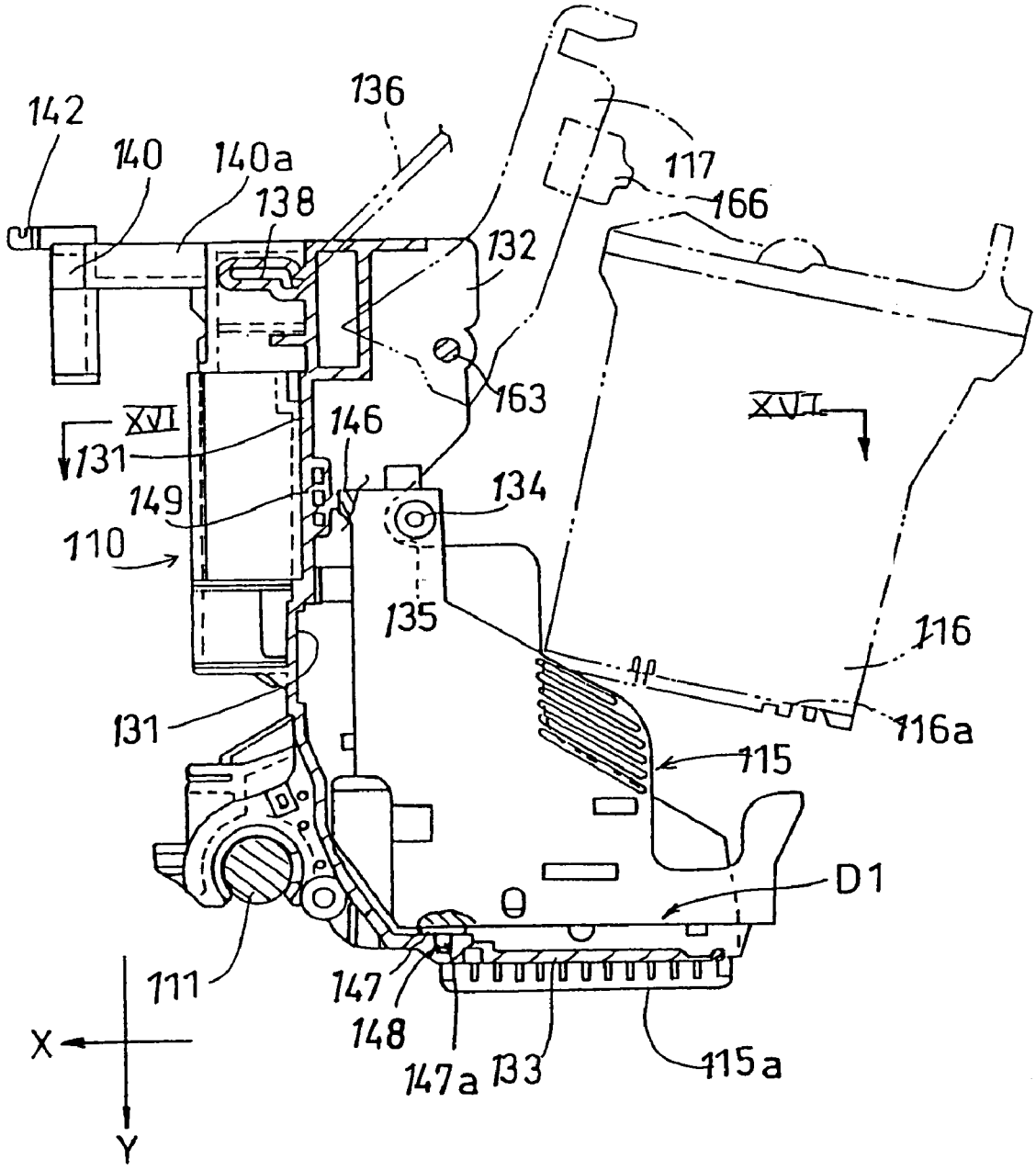
FIG. 15 a cross-sectional view taken along a line XV—XV in FIG. 14.

As shown in FIGS. 14 and 15, the carriage 110 is made up of a rear plate 131 and left and right side plates 132 extending frontwardly from the left and right edges of the rear plate 131. In the lowest portion of each of the side plates 132, a bottom support portion 133 is formed which inwardly projects for supporting the head unit 115. As shown in FIG. 15, a head setting portion D1 is defined by a space above the position between the bottom support portions 133, 133. The head unit 115 is set to the head setting portion D1 in an orientation in which the nozzle surfaces 115*a* face downward. The front and top of the head setting portion D1 is open to facilitate mounting the head unit 115 and the ink cartridge 116 on the carriage 110.

Figure 17:
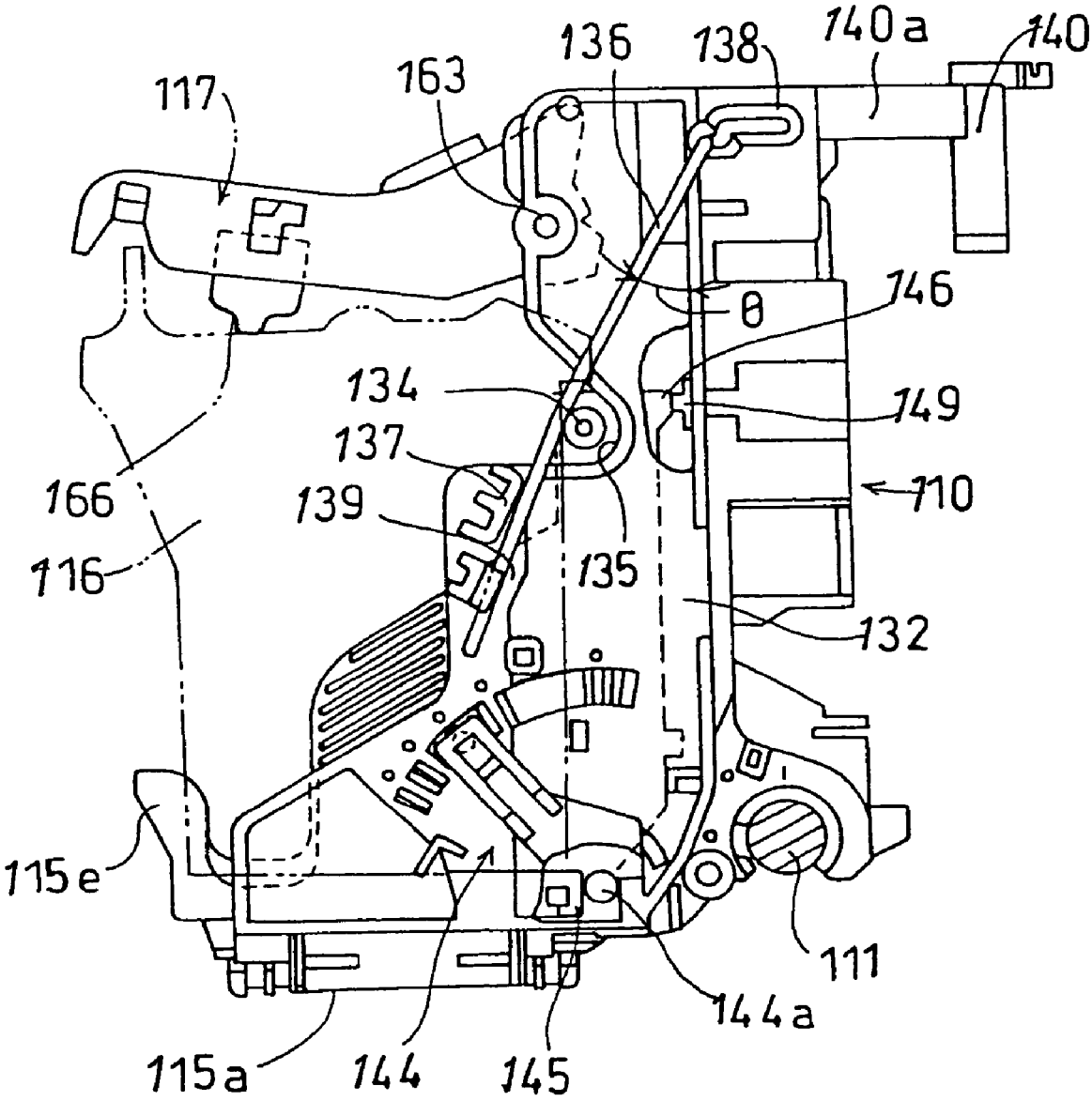
FIG. 17 is a right side cross-sectional view showing the carriage on which the head unit is mounted.

As shown in FIG. 15, a recess 135 is formed in the middle portion of each of the side plates 132, and an attachment hole 138 is formed in the upper portion of each of the side plates 132. One end of a line shaped spring 136 is rotatably attached to the attachment hole 138. As shown in FIGS. 14 and 17, each of the side plates 132 is formed with a first engagement portion 137 protruding outward from a frontward and downward position of the recess 135. The free end of the spring 136 is blocked by the first engagement portion 137 so as not to move upward. In a position slightly below the first engagement portion 137, a second engagement portion 139 is formed for preventing the free end of the spring 136 from projecting outwardly of the side plate 132.

As shown in FIGS. 4 and 15, the head unit 115 has the nozzle surface 115*a* in the lower side of the bottom plate 115*b*. The bottom plate 115*b*, left and right side-plates 115*c*, 115*c*, rear plate 115*d*, and front plate 115*e* define an internal space serving as an ink cartridge receiving portion D2. Four manifold ports 162, with which ink ejection ports 116*a* (see FIGS. 15 and 18) at the lower surfaces of four color ink cartridges 116 are engaged, are formed in the bottom plate 115*b*. Partition plates 115*f* are formed on the bottom plate 115*b* in an upstanding condition to define the positions where the ink cartridges 116 are set.

Figure 16:
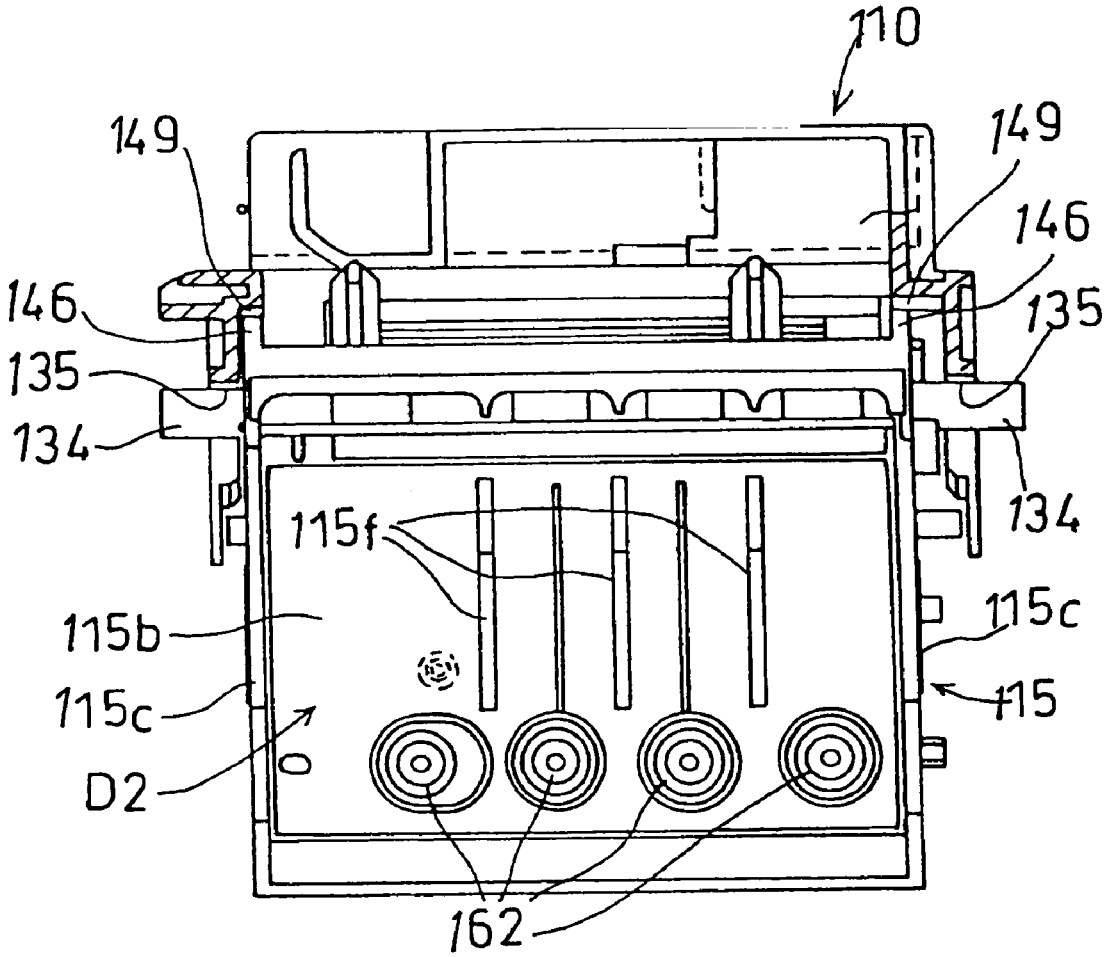
FIG. 16 is a cross-sectional view taken along a line XVI—XVI in FIGS. 14 and 15.

As shown in FIG. 4, an engagement pin 134 is formed on the outer surface of each of the side-plates 115*c*, 115*c* to project outward. An abutment block 145 projects from the outer surface of the right side plate 115*c*. The abutment block 145 is brought into abutment with a cam 144*a* (see FIG. 17) of a slant adjustment mechanism 144 provided to the carriage 110. The slant adjustment mechanism 144 is provided for adjusting slant of the head unit 115. Further, as shown in FIGS. 15, 16 and 17, abutment projections 146 are formed in the leftmost and rightmost positions of the rear plate 115*d* to project rearward. As shown in FIG. 15, at left and right sides of the bottom plate 115*b* of the head unit 115, downwardly projecting abutment portions 147 are formed integral with the bottom plate 115*b*. A downwardly projecting positioning projection 147*a* is further formed on the leftside abutment portion 147.

As shown in FIGS. 14 and 15, in order to accurately position and firmly fix the head unit 115 to the head receiving portion D1 of the carriage 110, the engagement pins 134 projecting outward from the left and right sides of the head unit 115 are brought into engagement with the recess portions 135 formed in the left and right side-plates 132. Then, the abutment portions 147 are mounted on the bottom support portions 133. The positioning projection 147*a* is brought into engagement with a receiving groove 148 (see FIG. 15) formed in the leftside bottom support portion 133. In this condition, the engagement pin 134 is urged by the spring 136 in an obliquely downward direction. Also, the free end of the spring 136 is engaged with the first engagement portion 137 so as not to allow the upward movement of the spring 136. The free end of the spring 136 is further engaged with the second engagement portion 139 so as not to project outwardly of the side plate 132.

As shown in FIGS. 11 and 17, the springs 136 urge at their midpoint the engagement pins 134 of the head unit 115 obliquely downwardly toward the rear plate of the carriage 110. With the X component force (i.e., horizontal component as shown in FIG. 15) of the urging force imparted by the springs 136, the abutment projections 146 are horizontally brought into abutment with support projections 149 formed in the rear plate 131 of the carriage 110, and at the same time the abutment block 145 urges the cam 144*a* as shown in FIG. 17.

The bottom support portions 133 at the left and right sides of the carriage 110 can withstand the force downwardly exerted by the abutment portion 147 resulting from the Y component force (i.e., vertical component as shown in FIG. 15) of the urging force imparted by the springs 136. By setting a slant angle of the springs 136 with respect to the vertical line to more than 145 degrees, the X component force can be made greater than the Y component force. By doing so, the head unit 115 is urged against the rear plate with force stronger than the urging force for urging the head unit 115 against the bottom of the carriage 110. Because the highly rigid rear plate 131 plays a major role in supporting the head unit, it is not necessary that the bottom support portions 133 be as rigid as the rear plate 131. Further, the head unit can be easily postured and positioned when mounting on the carriage 110, so that mounting of the head unit 115 on the carriage 110 can be accomplished firmly. Furthermore, due to large open space reserved in front of the carriage, the head unit 115 can be easily set to and detached from the head receiving portion D1.

Figure 19A:
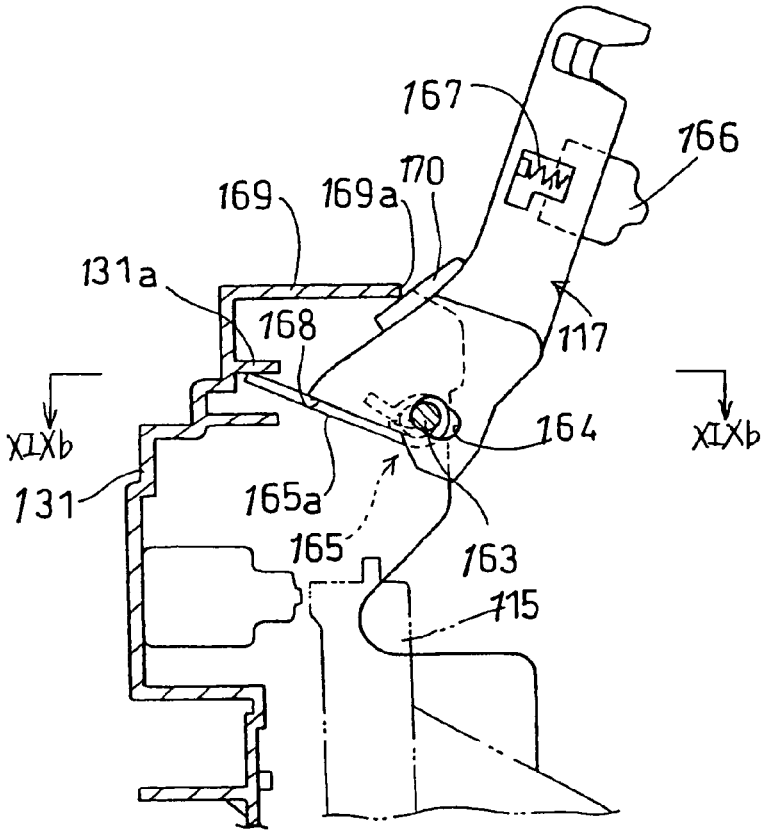
FIG. 19(*a*) is a side view showing a fully opened condition of the locking arm.
Figure 19B:
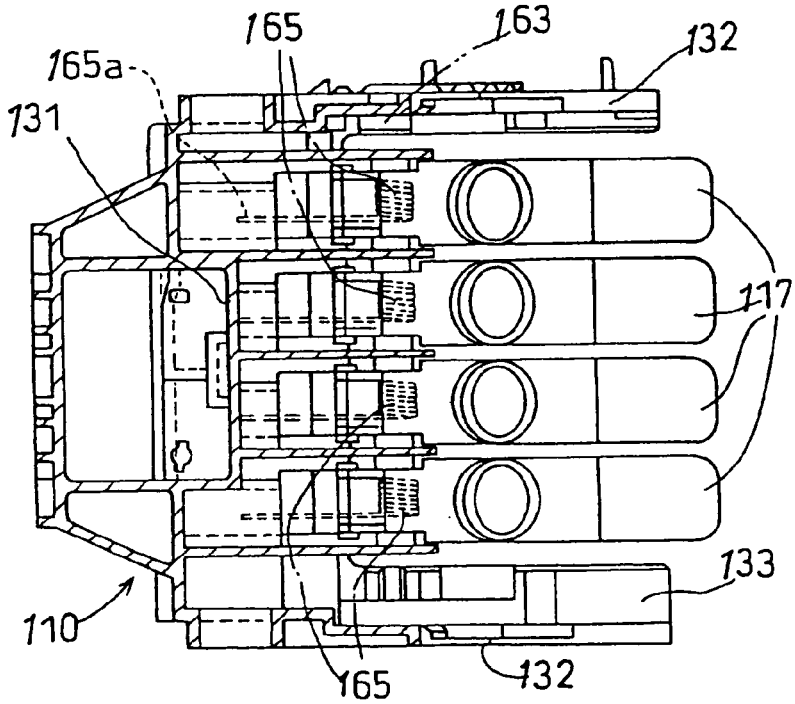

As shown in FIGS. 11–12, 14–15, 19(*a*)–19(*b*) and 20(*a*)–20(*b*), a shaft 163 extends horizontally and is supported between the left and right side-plates 132 of the carriage 110. An engagement hole 164 is formed in each of the four locking arms 117 provided to respective ones of the four color ink cartridges 116. The engagement hole 164 is a vertically elongated shape with an upper part being a semi-circular shape of a larger diameter and a lower part being a semi-circular shape of a smaller diameter. The shaft 163 passes through the engagement holes 164 to swingably support the locking arms 117. The locking arms 117 downwardly urge the respective upper surfaces of the ink cartridges 116. The diameter of the lower part of the engagement hole 164 is approximately equal to the diameter of the shaft 163. On the other hand, the diameter of the upper part of the engagement hole 164 is approximately as 1.5 times as large as the diameter of the shaft 163. As shown in FIG. 19(*a*), a torsion spring 165 is loosely fitted to the shaft 163 with one end being secured to the locking arm 117 and another end 165*a* being engaged with an upper engagement portion 131*a* formed in the rear plate 131 of the carriage 110. As such, the shaft 163 is always upwardly biased by the torsion spring 165.

A pressing block 166 is provided on the inner surface of the locking arm 117 in a position near the free end of the locking arm 117. The pressing block is slidably movable in a direction perpendicular to the inner surface of the locking arm 117. A biasing spring 167 is interposed between the top plate of the locking arm 117 and the pressing block 66 to urge the latter downward. When the locking arm 117 is downwardly rotated about the shaft 164, the pressing block 166 is brought into abutment with the upper surface of the ink cartridge 116 to press the ink cartridge 116 downward. The position of the pressing block 166 on the locking arm 117 is determined so that the manifold port 162 of the head unit 115 is located directly below the abutment point of the pressing block 166 against the upper surface of the ink cartridge 116. With the locking arm 117, the ink cartridge 116 can be firmly mounted on the carriage 110 without imparting undue load upon the carriage 110 because the carriage 110 has already been firmly held by the force of spring 136.

Figure 12:
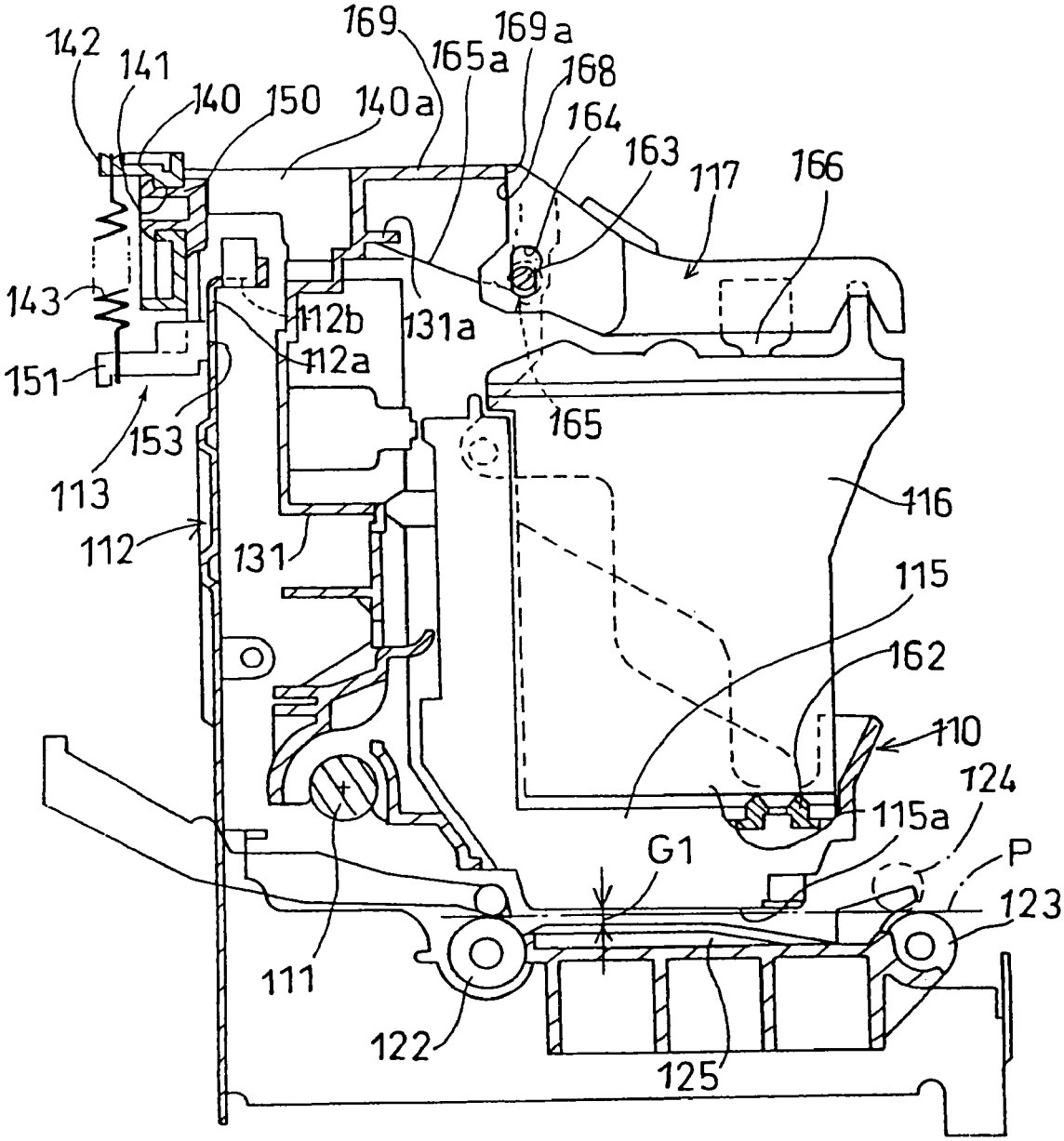
FIG. 12 is a cross-sectional view showing the ink cartridge mounted on the head unit in which the gap between the ink jet head and the platen is set large.
Figure 13A:
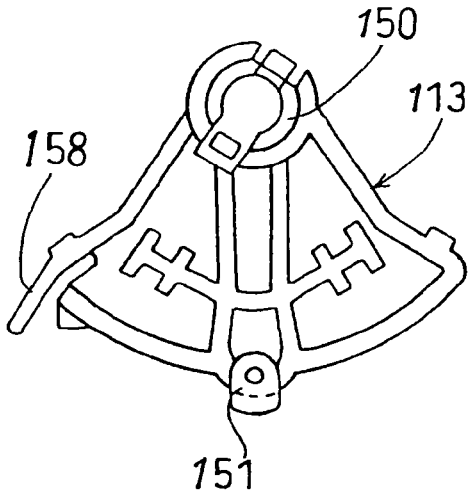
FIG. 13(*a*) is a rear view showing the changeover member used in the second embodiment.
Figure 13B:
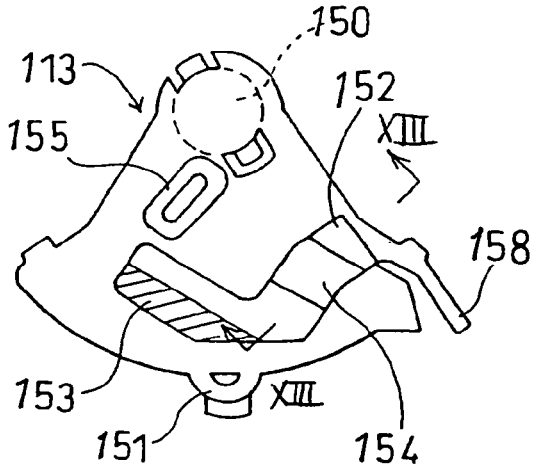
Figure 13C:
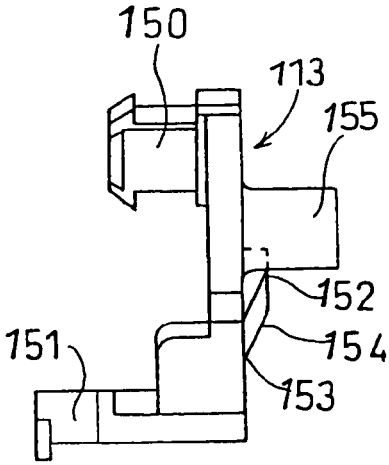
Figure 13D:
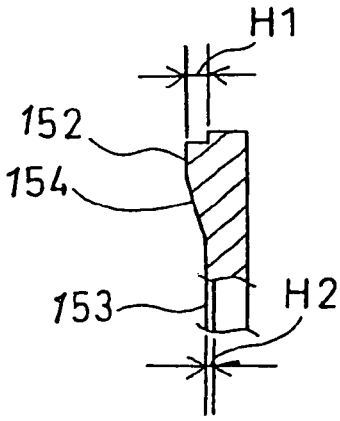
Figure 18:
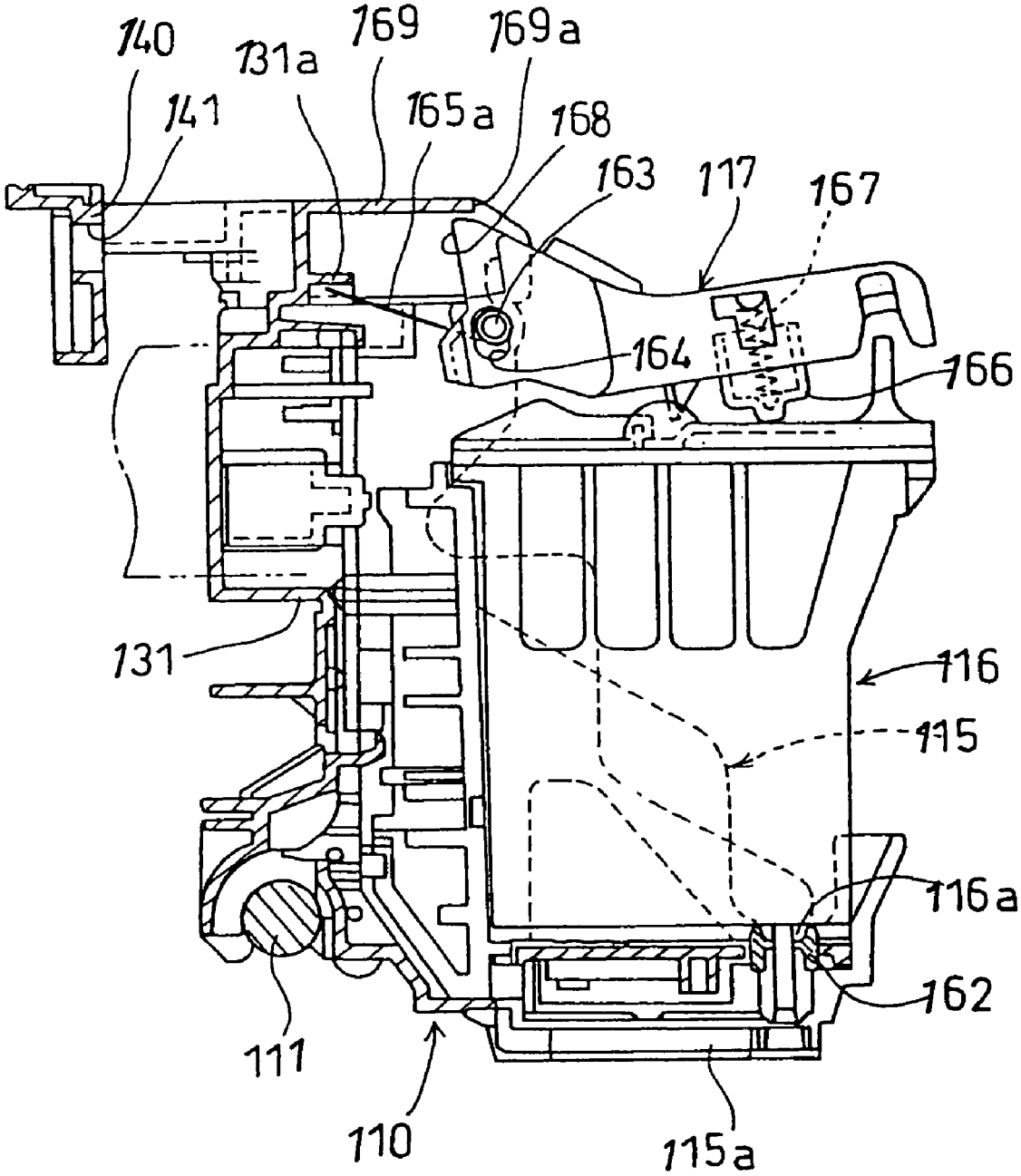
FIG. 18 is a cross-sectional view showing a state just before the ink cartridge is locked by a locking arm.
Figure 20A:
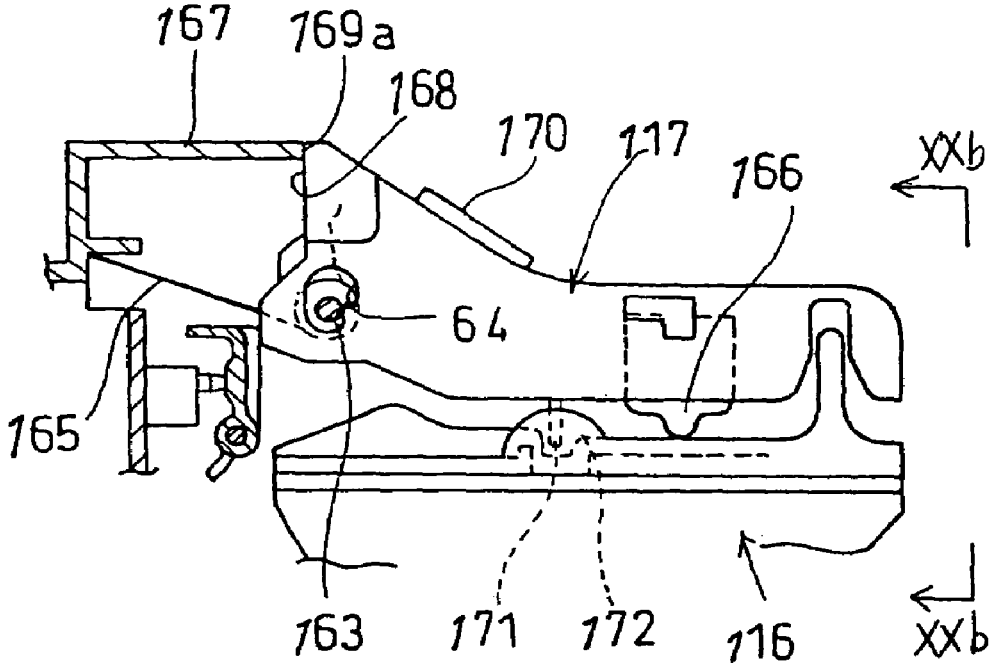
FIG. 20(*a*) is a cross-sectional view showing an unlocking condition of the locking arm.
Figure 20B:
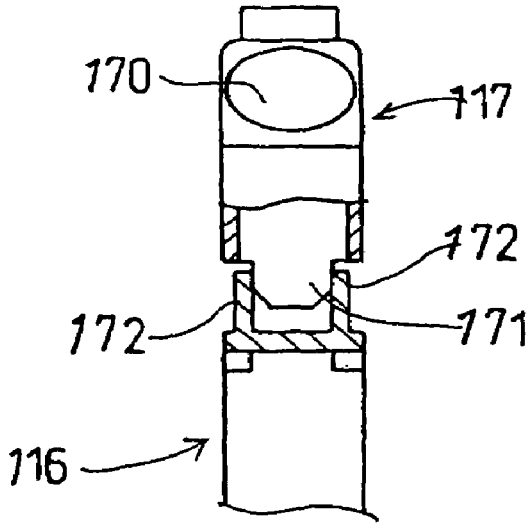

The locking arm 117 is loosely supported on the shaft 163. Therefore, when the locking arm 117 is in an open condition as shown in FIG. 15, the shaft 163 is in contact with the upper edge of the engagement hole 164, so that the engagement surface 168 and the locking portion 169*a* are disengaged from each other. When the free end of the locking arm 117 is pushed down, the pressing block 166 is brought into contact with the upper surface of the ink cartridge 116. As the locking arm 117 is further pushed down, the locking arm 117 rotates about the pressing point of the pressing block 166, causing the base side of the locking arm 117 to move upward. As shown in FIG. 18, the pressing lever 117 rotates while contacting the lower surface of the upper cover plate 169. Upon exceeding the tip end of the upper cover plate 169, the base end of the locking arm 117 is shifted upwardly by a distance equal to the vertical length of the elongated engagement hole 164. As a result, the shaft 163 is brought in contact with the lower edge of the engagement hole 164, and the engagement surface 168 of the locking arm 117 is brought in abutment with the locking portion 169*a*, the tip end of the upper cover plate 169. The ink cartridge locked condition is shown in FIGS. 12 and 20(*a*). In the locked condition of the ink cartridge 116, the locking portion 169*a* withstands reaction force (reaction moment) of the pushing force vertically exerted upon the free end of the locking arm 117. The locking portion 169*a* projects from the rear plate 131 of the carriage 110. Therefore, provided that the rear plate 131 is so rigid as to support the reaction force, the front plate of the carriage 110 is not required to be as rigid as the rear plate 131. Thus, the carriage 110 can be made compact. Further, the fact that the ink cartridge has locked can be easily recognized from click sound generated when the base end of the locking arm 117 is shifted upward and is brought into abutment with the locking portion 169*a*.

An operation button 170 is provided on the upper surface of the locking arm 117 and in the vicinity of the base end of the locking arm 117. Depression of the operation button 170 will release the pressing condition of the ink cartridge 116. When the operation button 170 is depressed, the engagement surface 168 of the locking arm 117 is disengaged from the rigid locking portion 169*a* and downwardly shifted. At the same time, the free end of the locking arm 117 moves upward. As shown in FIG. 19(*a*), due to the biasing force of the torsion spring 165 and the abutment of the operation button 170 with the locking portion 169*a*, the locking arm opened condition is maintained. In this condition, a large space is provided above and in front of the carriage 110, so that the user can easily replace the ink cartridge 116 (see FIGS. 15 and 18).

The vertical dimension of the locking portion 169*a* is set smaller than the vertically movable distance of the locking arm 117 in the position of the shaft 163 (which distance is given by subtracting a diameter of the shaft 163 from the vertical distance of the elongated hole 163). By doing so, the locked condition can easily be released with a small amount of downward movement of the operation button 170.

As shown in FIG. 20(*b*), the locking arm 117 is an inverted U-shaped in cross-section. In the middle portion between the free end and base end of the locking arm 117, a regulation blade 171 is downwardly projected from the inner surface of the inverted U-shaped locking arm 117. A pair of upstanding walls 72 are formed in a spaced-apart relation on the upper surface of the ink cartridge 116. When the locking arm 117 is downwardly moved to press the ink cartridge 116, the regulation blade 171 is inserted between the upstanding walls 172, thereby preventing the ink cartridge 116 from deviating rightward or leftward.

The facsimile/printer combined device 101 according to this embodiment can execute facsimile functions, a document copying function, a printing function, and a scanner function in accordance with various instructions entered by a user through the operation panel 106. The facsimile functions include setting various process operations, reading document images with the original document reading unit 105, creating transmission data of the original document, encoding the transmission data, transmission and reception of facsimile data from a remote facsimile device through a telephone line, decoding reception data, and recording images on a sheet of paper P with the recording unit based on the decoded facsimile data. The document copying function includes reading the original document with a CIS (contact image sensor) of the original document reading unit 105, and forming color images on the sheet of paper P with various units in the recording section. The printing function includes receiving print data from an external device, such as a personal computer, through a printer cable or wirelessly with infrared light, and forming color images on the sheet of paper P based on the print data. The scanner function includes transmitting image data read with the original document reading unit 105 to the external device.

This embodiment has a gap adjusting capability in which a gap between the face of the recording head unit 105 and the sheet of paper P is adjusted using a gap adjustment mechanism 130.

As shown in FIGS. 12 and 17, a bracket 140 is attached via a pair of left and right bracket connecters 140*a* to the upper portion of the rear plate 131 of the carriage 110 so as to be integral with the carriage 110. The bracket 140 faces backward and downward. A changeover member 113, which is made from a synthetic resin, is rotatably engaged with the bracket 140. The rear view of the changeover member 113 is shown in FIG. 13(*a*), and the front view in FIG. 13(*b*). As shown, the changeover member 113 is in a sector shape as viewed from the front (or rear) side. A pivot shaft 150 is secured to the upper portion of the changeover member 113 and extends rearward. The pivot shaft 150 is rotatably inserted into a support hole 41 formed in the bracket 140. As shown in FIGS. 11 and 12, a coil spring 143 is stretched between an upper attachment 142 and a lower attachment 151. The upper attachment 142 is provided at the upper end of the bracket 140 to project rearward. The lower attachment 151 is provided at the lower end of the changeover member 113 to project rearward. The coil spring 143 changes the posture of the changeover member 113 and maintains the changed posture.

The changeover member 113 shown in FIGS. 13(*a*) and 13(*b*) is secured to the upper end of the carriage 110 so that a first abutment portion 152 or a second abutment portion 153 on the changeover member 113 contacts the slide surface 112*a* in the inner upper portion of the frame 112. When the changeover member 113 swings, the end face of the outer arcuate frame of the changeover member 113 is brought into abutment with the lower surface of one of the bracket connecters 140*a*, thereby restricting the changeover member 113 not to swing further angle.

As shown in FIGS. 13(*b*), 13(*c*) and 13(*d*), the first abutment portion 152 and the second abutment portion 153 are formed on the front surface of the changeover member 113. A sloped guide surface 154 interconnects the first and second abutment portions 153 and 154 which selectively contact the slide surface 112*a* of the frame 112. The first abutment portion 152, the second abutment portion 153 and the sloped guide surface 154 are located in positions apart by the same distance from the center of the pivot shaft 150. The level or height H1 of the first abutment portion 152 measured from the front surface of the changeover member 113 is greater than the height H2 of the second abutment portion 153. A changeover abutment portion 155 is also formed in the front surface of the changeover member 113 to project frontward. The position in which the changeover abutment portion 155 is formed is nearer to the center of the pivot shaft 150 than the positions of the first and second abutment portions 152 and 153.

As shown in FIG. 12, the uppermost part of the frame 112 is horizontally frontwardly bent to form a rail portion 112*b*. As shown in FIG. 10(*a*), a first posture changing piece 156 is provided in the left side vicinity of the rail portion 112*b* and in further left side of the flushing section 129. The first posture changing piece 156 is an upstanding member and changes the swinging posture of the changeover member 113. A second posture changing piece 157 is provided in the right side vicinity of the rail portion 112*b* and in the center of the maintenance section 127. The second posture changing piece 157 is an inverted V-shape as viewed from front side.

Next, a gap adjustment operation will be described. With the gap adjustment operation, the gap between the head unit 101 and the upper surface of the platen 125 is adjusted. When, for example, the printing function is to be implemented, a printer driver software installed in the personal computer is run. Then, the recording medium to be used is selected. At this time, if a plain paper is selected as the recording medium to be printed, the gap can be set small. If an envelope is selected, the gap can be set large.

First, printing on the plain paper will be described. Before a print instruction is issued from the personal computer, the carriage 110 is located in the home position confronting the purging unit 128. When the print instruction is issued, the carriage 110 moves leftward (indicated by a letter "A" in FIG. 10(*a*)). When the carriage 110 moves beyond the flushing section 129, the side surface of the changeover abutment portion 155 impinges upon the rightside surface of the first posture change piece 156, so that the changeover member 113 rotates counterclockwise as viewed from front.

The counterclockwise rotation of the changeover member 113 causes the coil spring 143 to approach the leftside of the pivot shaft 150. And, the changeover member 113 keeps on rotating while the sloped guide surface 154 is slidably contacting the slide surface 112*a*. As the carriage 110 further moves leftward, the changeover member 113 is further rotated counterclockwise and placed in such a condition that its rightside is oriented upward and the second abutment portion 153 approaches the rear surface of the frame 112. Accordingly, the nozzle surface 115*a* of the head unit 115 approaches the upper surface of the platen 125. As a result, the gap G1 is reduced.

Characters can be printed on a plain paper within a printable range L1 by moving the carriage 110 rightward (indicated by a letter "B" in FIG. 10(*a*). The range L2 within the printable range L1 indicates a carriage return range when characters are printed on the plain paper. The range L2 is located in the leftside of the position for changing over the gap G1 to a large value.

More specifically, when printing is carried on the plain paper, it is necessary to move the carriage 110 within the range L2 that is longer than the printable range L1 by an acceleration distance ΔL at its rightside and also by the same distance at its leftside. Even when the carriage 110 moves to the rightmost position of the range L2, the small gap G1 can be preserved because the changeover abutment portion 155 is not brought into abutment with the second posture changeover piece 157.

In the rightside position where is further rightside of the rightmost position of the range L2, the posture changeover operation is implemented by the second posture changeover piece 157 in order to increase the gap G1. The home position (capping position) is located in a further rightside position with respect to the position in which the posture changeover operation is implemented. On the other hand, the flushing position is located in a leftside position with respect to the leftmost position of the printable range L1. In a position further leftside of the flushing position and further leftside of the leftmost position of the range L2, the posture changeover operation is implemented by the first posture changeover piece 156 in order to reduce the gap G1. Therefore, as far as the carriage 110 reciprocates with forward and backward movements within the range L2, printing on the plain paper can be implemented under the condition where the gap G1 is maintained small. When the flushing operation is to be carried out at a regular interval during printing, the flushing operation can be carried out while maintaining the gap G1 small.

When the characters are printed on the envelope that is thicker than the plain paper, the gap G1 needs to be greater than that set for printing on the plain paper. Because the envelope being transported in the paper transportation path is brought into contact with the nozzle surface 115*a* and the surface of the envelope is smeared with ink. Accordingly, to print on the envelope, the gap adjustment is performed so as to increase the gap. After finishing the printing operation on the plain paper, the carriage 110 is moved rightward in FIG. 10(*a*) (in the direction of "B") so that the carriage 110 is moved toward the home position (cap position) 128. As the changeover abutment portion 155 overrides the uppermost vertex portion of the second posture changeover piece 157, the changeover member 113 rotates clockwise. Then, the first abutment portion 152 is brought into contact with the slide portion 112*a* of the frame 112 upon sliding the sloped guide portion 154. At this time, the coil spring 143 stretched between the upper attachment 142 and the lower attachment 151 is moved to the leftside of the pivot shaft 150, the changeover member 113 changes its posture so that its leftside is oriented upward. The changed posture is maintained due to the biasing force of the coil spring 143.

Because the high level first abutment portion 152 of the changeover member 113 slides the slide surface 112*a* of the frame 112, the lower surface of the carriage 110 is rotated upward about the guide shaft 111 (counterclockwise in FIG. 12) so that the gap G1 is increased. The printable range L3 for the envelopes is longer than the printable range L1 for the plain paper and the former is inside the latter. Therefore, as far as the carriage 110 is moved within the range L4, the large gap is preserved even if the carriage 110 is moved to the leftmost position of the range L4 and to the flushing position. In this case, the changeover abutment portion 155 does not impinge upon the first posture changeover piece 156.

Therefore, as far as the carriage 110 moves reciprocally with forward and backward movements within the range L4, printing on the envelope is carried out while preserving the large gap. When the flushing operation is to be performed during printing, the flush operation can be performed while preserving the large gap. As such, it is not necessary to move the carriage 110 to the position where the changeover abutment portion 155 is brought into abutment with the second posture changeover piece 157 each time when the flushing operation is performed. For this reason, printing on the envelope can be quickly accomplished.

The above-described embodiment can be applied to a recording head 115 with the carriage 110 integrally formed thereon. For the carriage 110 mounting the recording head 115 with the nozzle surface 115*a* oriented in a horizontal direction, the above-described rear plate 131 is used as a bottom plate. In such a case, the above portion of the carriage 110 is open and only the free end of the locking arm 117 extends upward, therefore, replacement of the ink cartridge can be easily performed.

While the invention has been described in detail with reference to specific embodiments thereof, it would be apparent to those skilled in the art that many modifications and variations may be made therein without departing from the spirit of the invention, the scope of which is defined by the attached claims. While the embodiments described above use an ink jet printer as the image-forming device, the present invention is not limited to this apparatus, but can be applied to an ink jet type photocopier, facsimile device, and the like. In addition, four ink cartridges are mounted in the ink jet printer, but any number of ink cartridges can be provided.

What is claimed is:

1. An ink cartridge, comprising:

a cartridge case having a first side wall, a second side wall opposite from the first side wall, a front wall and a back wall opposite from the front wall;

a bottom plate attached to a first end of the cartridge case; and a cover attached to a second end of the cartridge case;

wherein:

the bottom plate includes an ink port through which ink is transmitted to an exterior of the cartridge during operation, the ink port being positioned closer to the first side wall than to the second side wall;

the bottom plate includes a recessed portion, the recessed portion being recessed with respect to an adjacent unrecessed area of the bottom plate and being positioned closer to the second side wall than to the first side wall;

the recessed portion is formed in a shape capable of accommodating an engagement protrusion of an image forming apparatus;

the recessed portion includes a particular portion that is not open to the exterior of the ink cartridge on a front-wall side and on a back-wall side, the particular portion of the recessed portion being capable of accommodating the engagement protrusion of an image forming apparatus;

the ink port is situated between the first side wall and the recessed portion; and a diameter of the ink port is smaller than a width of the recessed portion.

2. The ink cartridge of claim 1, wherein the recessed portion is positioned such that the bottom plate includes a first unrecessed portion between the recessed portion and the first side wall, and a second unrecessed portion between the recessed portion and the second side wall.

3. The ink cartridge of claim 1, further comprising a cartridge sub-case accommodating a porous member, the cartridge sub-case being positioned within the cartridge case.

4. The ink cartridge of claim 1, wherein the bottom plate includes an air port through which air is transmitted to an interior of the cartridge during operation, the air port being positioned closer to the second side wall than to the first side wall.

5. The ink cartridge of claim 1, wherein the ink port is surrounded by a second recessed portion, the second recessed portion being recessed with respect to a remainder of the bottom surface.

6. The ink cartridge of claim 1, wherein the first side wall includes an inclined portion, the inclined portion being inclined with respect to a remainder of the first side wall.

7. The ink cartridge of claim 1, wherein the second side wall is provided with at least two protrusions extending away from the second side wall, and a substantially planar surface positioned between the at least two protrusions.

8. The ink cartridge of claim 1, wherein the cover includes an engagement recess positioned in a substantially intermediate position between the first side wall and the second side wall, the engagement recess being capable of engaging an engagement protrusion in an image forming apparatus.

9. The ink cartridge of claim 1, wherein the cover is provided with at least two protrusions extending away from the cover, and a substantially planar surface positioned between the at least two protrusions.

10. The ink cartridge of claim 1, wherein the cover is provided with a gripping portion extending away from the cover, the gripping portion being positioned closer to the first side wall than to the second side wall.

11. An ink cartridge, comprising:

a cartridge case having a first wall, a second wall opposite from the first wall, a third wall and a fourth wall opposite from the third wall;

an first end surface at a first end of the cartridge case extending from the first wall to the second wall; and a second end surface at a second end of the cartridge case, the second end being opposite from the first end and extending from the first wall to the second wall;

wherein:

the first end surface includes an ink opening through which ink is transmitted to an exterior of the cartridge during operation, the ink opening being positioned closer to the first wall than to the second wall;

the first end surface includes a recessed portion, the recessed portion being recessed with respect to an adjacent unrecessed area of the first end surface and being positioned closer to the second wall than to the first wall;

the recessed portion is formed in a shape capable of accommodating an engagement protrusion of an image forming apparatus;

the recessed portion includes a particular portion that is not open to the exterior of the ink cartridge on a third-wall side and on a fourth-wall side, the particular portion of the recessed portion being capable of accommodating the engagement protrusion of an image forming apparatus;

the ink opening is situated between the first wall and the recessed portion; and a diameter of the ink opening is smaller than a width of the recessed portion in a direction from the third wall to the fourth wall.

12. The ink cartridge of claim 11, wherein the recessed portion is formed in a shape capable of engaging an engagement protrusion of an image forming apparatus.

13. The ink cartridge of claim 11, further comprising a cartridge sub-case, the cartridge sub-case being positioned within the cartridge case.

14. The ink cartridge of claim 11, wherein the first end surface includes an air opening through which air is transmitted to an interior of the cartridge during operation, the air opening being positioned closer to the second wall than to the first wall.

15. The ink cartridge of claim 14, wherein the ink opening, the air opening and the recessed portion are arranged in order on the first end surface between the first wall and the second wall.

* * * * *